US005718145A

United States Patent [19]

Grabbe

[11] Patent Number: 5,718,145

[45] Date of Patent: Feb. 17, 1998

[54] MACHINE FOR PERFORMING HIGH SPEED STAMPING AND FORMING OPERATIONS

[75] Inventor: Dimitry Grabbe, Middletown, Pa.

[73] Assignee: The Whitaker Corporation, Wilmington, Del.

[21] Appl. No.: 496,376

[22] Filed: Jun. 29, 1995

[51] Int. Cl.[6] ..... B21D 37/18

[52] U.S. Cl. ..... 72/456; 72/452.5; 72/347

[58] Field of Search ..... 72/456, 452.5, 72/347, 349

[56] References Cited

U.S. PATENT DOCUMENTS

| | | | |
|---|---|---|---|
| 4,173,138 | 11/1979 | Main et al. | 72/349 |
| 4,578,981 | 4/1986 | Nishikawa et al. | 72/347 |
| 4,934,167 | 6/1990 | Grims et al. | 72/456 |
| 4,976,131 | 12/1990 | Grims et al. | 72/456 |
| 4,996,865 | 3/1991 | Haulsee et al. | 72/349 |
| 5,555,761 | 9/1996 | Lavy | 72/456 |

OTHER PUBLICATIONS

Software package titled Advanced Rotating Machinery Dynamics, published by RBTS, Inc., Conshohocken, PA, pp. 7–49 thru 7–51 and 7–76 thru 7–77.

*Primary Examiner*—David Jones

*Attorney, Agent, or Firm*—James Trygg; Salvatore Anastasi

[57] ABSTRACT

A high speed stamping and forming machine (10) is provided having a ram (34) capable of sustained high speed operation. The ram (34) is pivotally attached to a connecting rod (36) which is eccentrically coupled to a drive shaft by means of an eccentric (40) and hydrostatic bearing (50). The drive shaft (30) is journaled in hydrostatic bearings (84, 86) in the frame (12) of the machine. The ram reciprocates toward and away from a bolster plate (20) within a ram bearing (138) having hydrostatic bearings therein. A source of high pressure hydraulic fluid is interconnected to the hydrostatic bearing (50) of the eccentric coupling by means of a fluid coupling (350, 352) consisting of telescoping tubes, one end of which engages a spherically shaped seat (356, 358) in the frame (12) that is in communication with the high pressure fluid source and the other end of which engages a spherical shaped seat (354) in the moving connecting rod (36), which is in communication via a passageway (60) with the hydrostatic bearing (50). A main counterweight (142) is provided on the drive shaft (30) to counterbalance the effects of the reciprocating ram and a two shaft (166), counter-rotating weight system counterbalances lateral loads imposed on the machine (10) by the main counterweight. The bolster plate (20) of the machine is provided with a deep support structure (24) and surrounding concrete (26) to form a stable base (28) to reduce vibrations caused by the impact of the tooling with the strip of material being formed or blanked.

23 Claims, 18 Drawing Sheets

MACHINE FOR PERFORMING HIGH SPEED STAMPING AND FORMING OPERATIONS

The present invention is related to machines that perform stamping and forming operations on strip material, and more particularly to such machines having relatively high speed reciprocating rams that carry and maintain the alignment of the stamping and forming tooling.

BACKGROUND OF THE INVENTION

Conventional stamping and forming machines typically operate from about 600 to a maximum of about 1400 strokes a minute during most stamping and forming operations on strip material. The number of parts that can be made in a given unit of time on such a machine is directly related to the number of strokes per minute that the machine is capable of performing. Higher speed machines, therefore, would be correspondingly more productive. An additional benefit of a higher speed ram, on the order of about 6000 strokes per minute, is that the stamping and forming of relatively harder materials is possible. With conventional stamping and forming machines the harder material would have to first be annealed and then rehardened after the stamping and forming operation. In cases where annealing is not possible, complex heat treatment processes may have to be utilized to prepare the material for stamping and forming, and in some cases the material may not be able to be stamped and formed using conventional machines. Attempts to substantially increase the speed of stamping and forming machines are generally frustrated by problems such as overheating of bearings, vibration due to slight out of balance conditions, and very low tool life caused in part by the increased relative speed of the mating tools and by increased machine vibrations that cause the cutting edges of the mating tooling to rub together and wear out prematurely. As the speed of the machine is increased, the relatively high mass of the reciprocating ram and connecting rod as well as the attached tooling becomes more difficult to adequately counterbalance. A machine of ten ton capacity operating at 6000 strokes per minute, can have a reaction force at the connecting rod bearing of about 26 tons while the mass of the tooling adds another 10 tons for a total working load of about 36 tons. Conventional roller bearings are unable to maintain such high speed at these high loads and ball bearings which can handle the speed are unable to survive the high loads. Additionally, the impact of the tooling on the strip material, during high speed stamping and forming operations, causes significant adverse machine vibration that contributes to unnecessary tool wear and objectionable noise. A further serious problem with increasing the speed of conventional stamping and forming machines is that the end point of tool position is speed dependant. The conventional machine structure has a substantial amount of elasticity so that at a particular speed the ram tooling will engage the platen tooling to a particular depth or tool position. The tooling is set up to operate at this one particular speed. If the speed is decreased or increased the end point of the tool position will change, depending upon the particular dynamics of the machine and tooling. This becomes a serious problem where precision forming and coining operations are needed. Tooling for such operations must be run at a particular speed, therefore, it is not possible to vary the speed of the machine, in these cases, to accommodate other variables such as heat and strip feed problems.

What is needed is a high speed stamping and forming machine that is capable of sustained operation of up to about 6000 strokes per minute without the adverse effects mentioned above. Machine vibration should be controlled to limit tool wear and reduce objectionable noise. Additionally, the machine should be structured so that the end point of tool position is not speed dependant.

SUMMARY OF THE INVENTION

A high speed machine is disclosed for performing stamping and forming operations on strip material. The machine includes a frame, a drive shaft journaled in the frame, and a base plate attached to the frame for holding first tooling, A ram is arranged to undergo reciprocating motion within a ram-way in the frame toward and away from the base plate along a ram axis. The ram carries second tooling for mating with the first tooling for performing the stamping and forming operations. A connecting rod is provided having a first end coupled to the drive shaft by means of an eccentric coupling and a second end pivotally coupled to the ram, both couplings effected by hydrostatic bearings, and arranged so that upon rotation of the drive shaft the connecting rod causes the ram to undergo reciprocating motion. An upper hydrostatic bearing and a lower hydrostatic bearing are provided coupling respective upper and lower portions of the ram to the ram-way and interconnected to a source of high pressure hydraulic fluid. The upper and lower hydrostatic bearings are arranged to position the ram within the ram-way so that the first and second tooling are in mutually precise lateral alignment in the absence of lateral alignment apparatus attached to the first and second tooling. Additionally, the frame of the machine includes structures to reduce vibration and operating noise which adversely affects tool life.

DESCRIPTION OF THE PREFERRED EMBODIMENT

Figure 1:
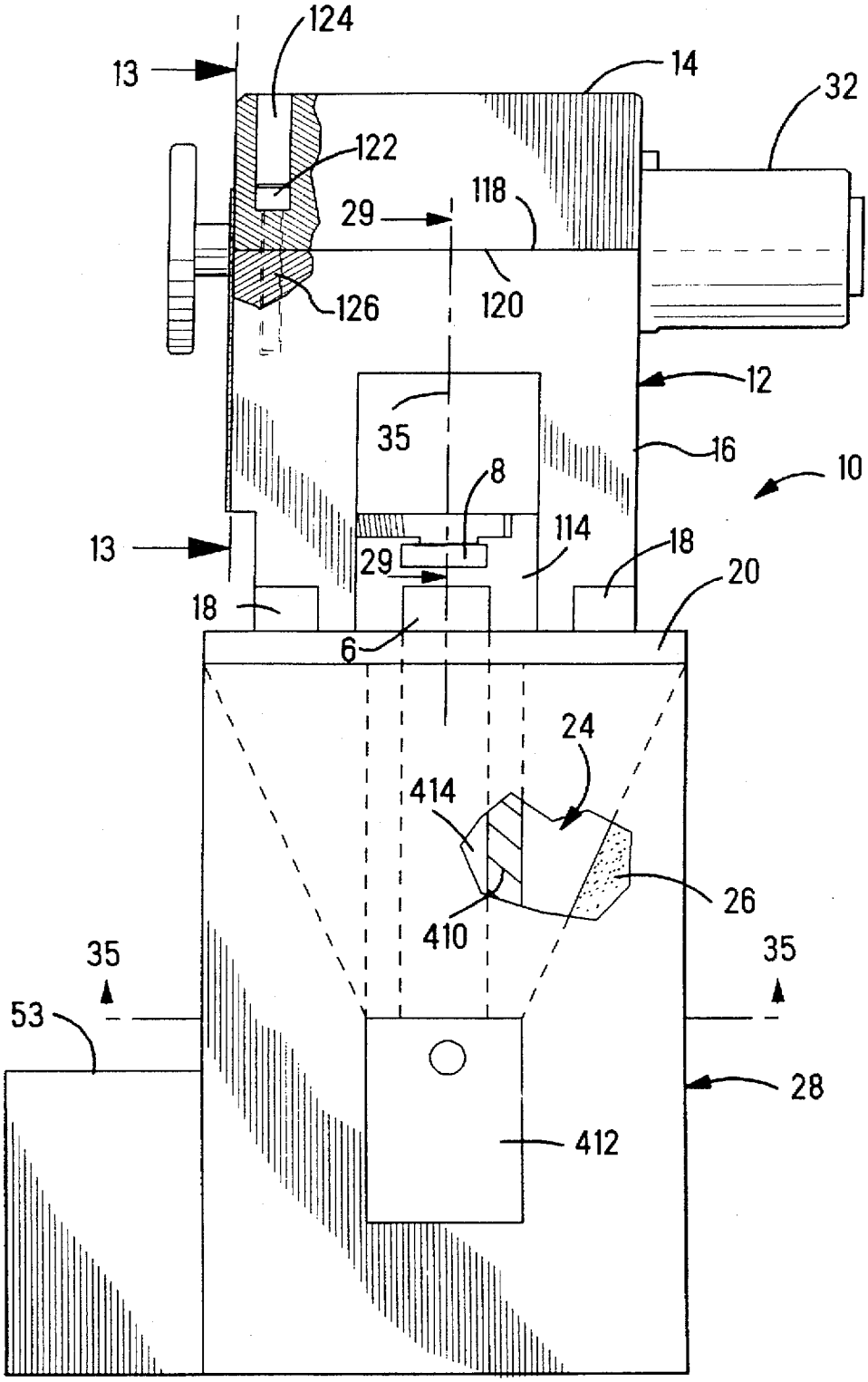
FIG. 1 is a front view of a stamping and forming machine incorporating the teachings of the present invention.
Figure 2:
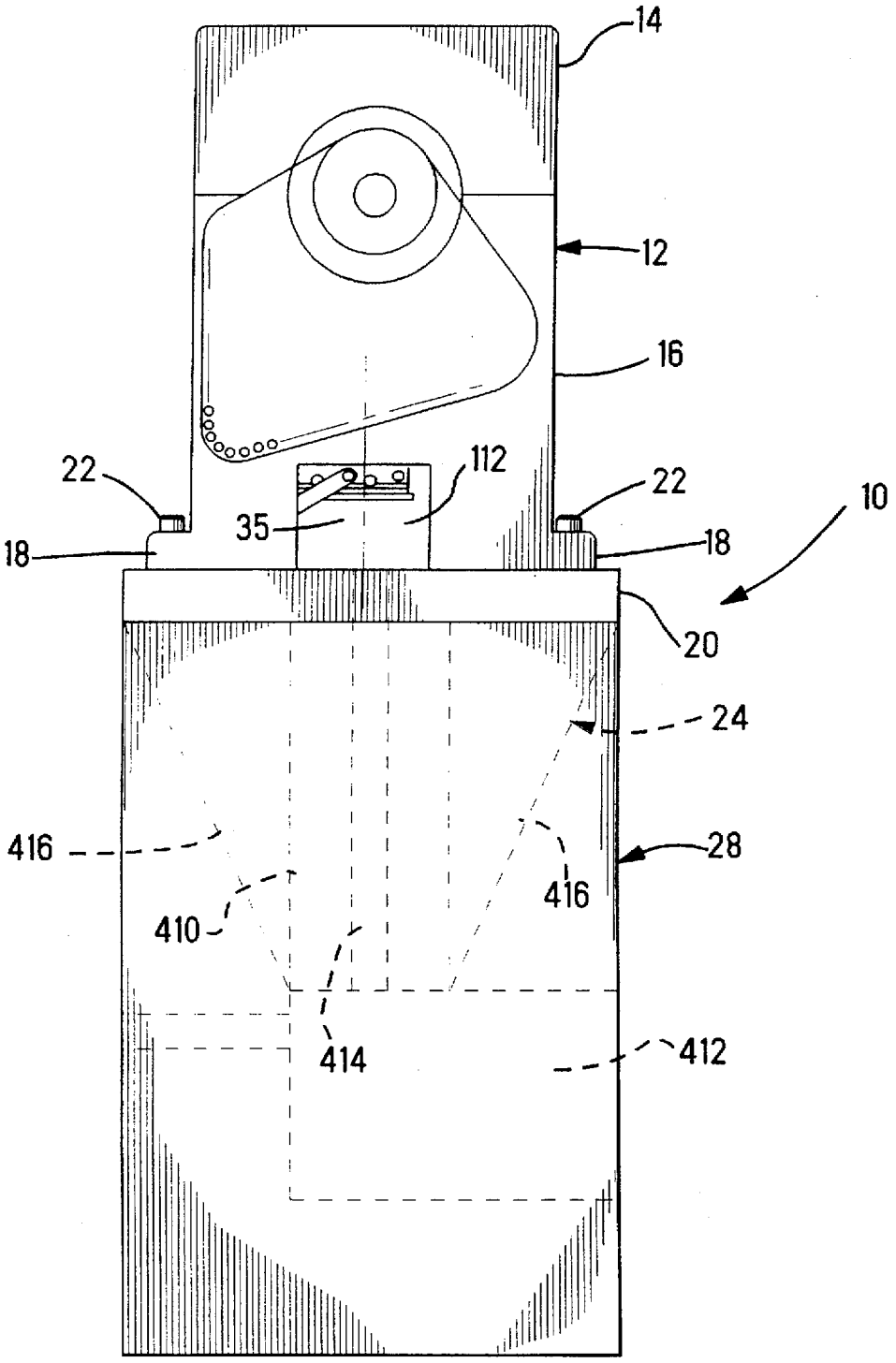
FIG. 2 is a left side view of the machine shown in FIG. 1.
Figure 5:
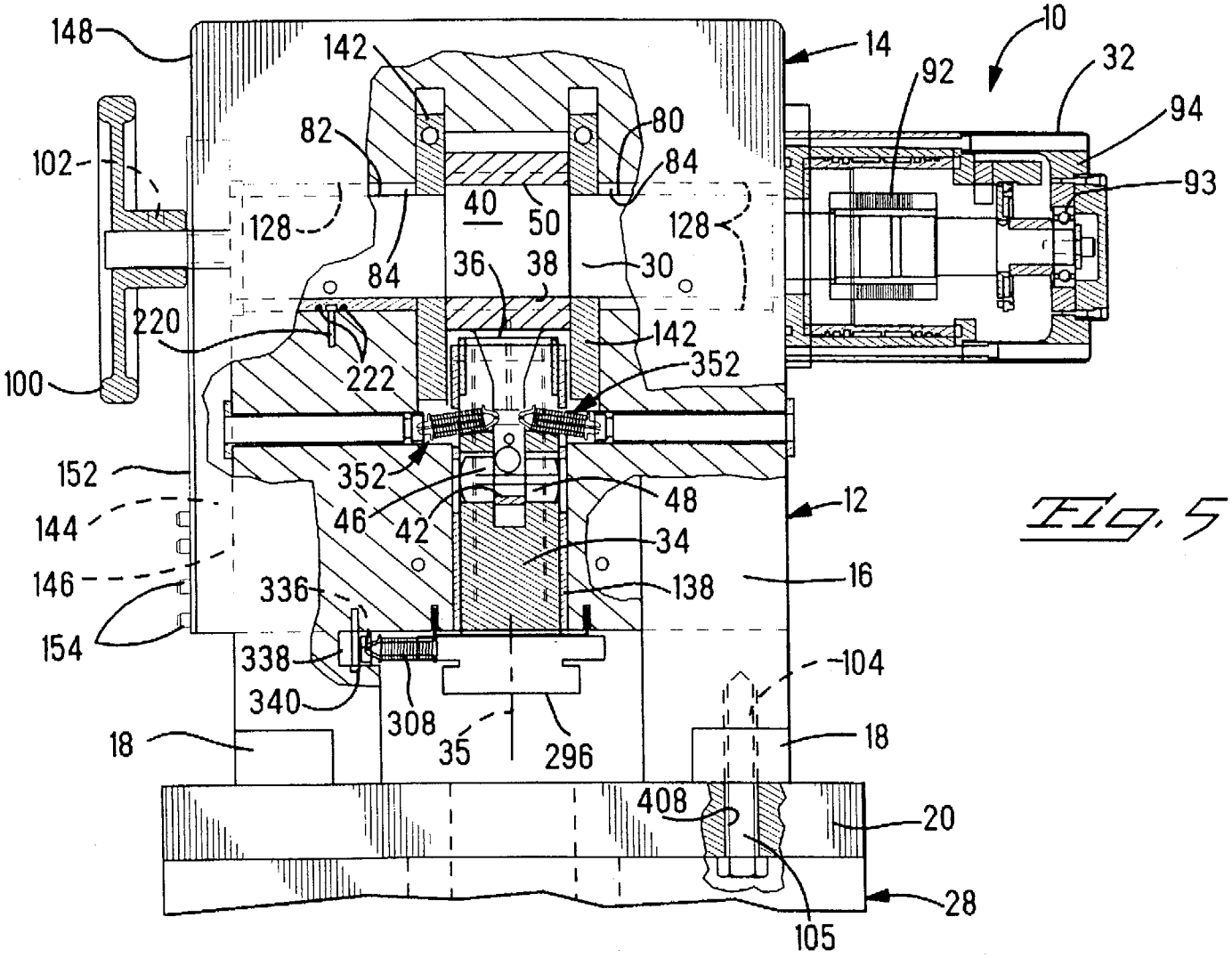
FIG. 5 is a partial cross-sectional view of the upper portion of the machine shown in FIG. 1.
Figure 8:
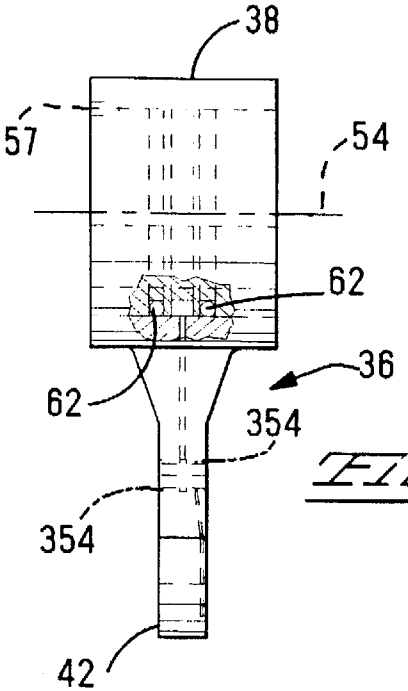
FIGS. 7 and 8 are side and front views, respectively, of the connecting rod of the machine.
Figure 7:
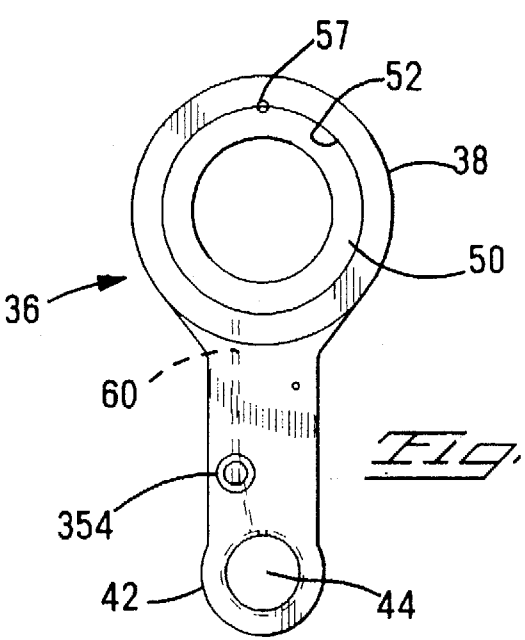

There is shown in FIGS. 1 and 2, a machine 10 having a frame 12 consisting of an upper frame 14 and a lower frame 16. The lower frame 16 includes four feet 18 that are bolted to a bolster plate 20 as will be explained below. The bolster plate 20 includes a support structure 24 that, in the present example, is embedded in concrete 26 to form a rigid vibration dampening base 28, however, the support structure 24 may include a base other than concrete. The support structure 24 and base 28 will be described in detail below. As best seen in FIG. 5, the machine 10 includes a drive shaft 30 driven by an electric motor 32. The drive shaft 30 is drivingly coupled to a ram 34 and arranged to impart reciprocating motion to the ram along a ram axis 35 so that it moves toward and away from the bolster plate 20 as the drive shaft rotates. First tooling 6 is secured to the bolster plate by the usual means and second tooling 8, that mates with the first tooling, is secured to the ram 34. During reciprocation of the ram, the first and second tooling cooperate to perform desired stamping and forming operations on strip material. A connecting rod 36, as shown in FIGS. 5, 7, and 8, has a first end 38 eccentrically coupled to an eccentric 40 that is formed as part of the drive shaft 30, in the usual manner. A second end 42 of the connecting rod is pivotally coupled to the ram 34 by means of a wrist pin 46 that extends through a bore 44 in the end 42, the wrist pin being journaled in bearings 48 in the ram. The first end 38 includes a bore 52 containing a hydrostatic bearing 50 for hydrostatic engagement with the eccentric 40. A source 53 of high pressure hydraulic fluid is shown schematically, in FIG. 1, and may include any suitable commercially available high pressure hydraulic delivery system having the capability of sustaining 8,500 to 10,000 pounds per square inch at a flow rate of 2.5 gallons per minute. The high pressure source 53 is interconnected to the machine with suitable high pressure lines, not shown, that are well known in the industry.

Figure 9:
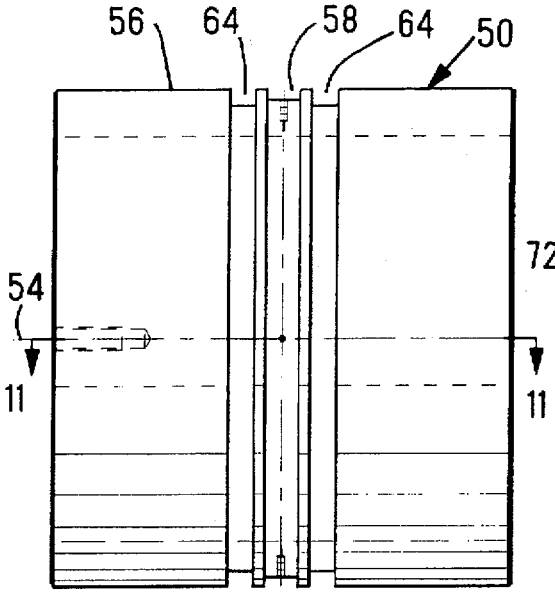
FIGS. 9 and 10 are plan and end views, respectively, of the connecting rod bearing.
Figure 10:
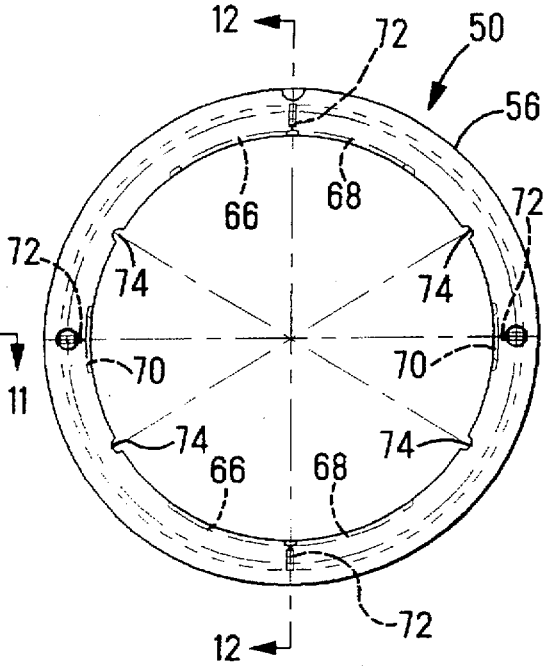
Figure 11:
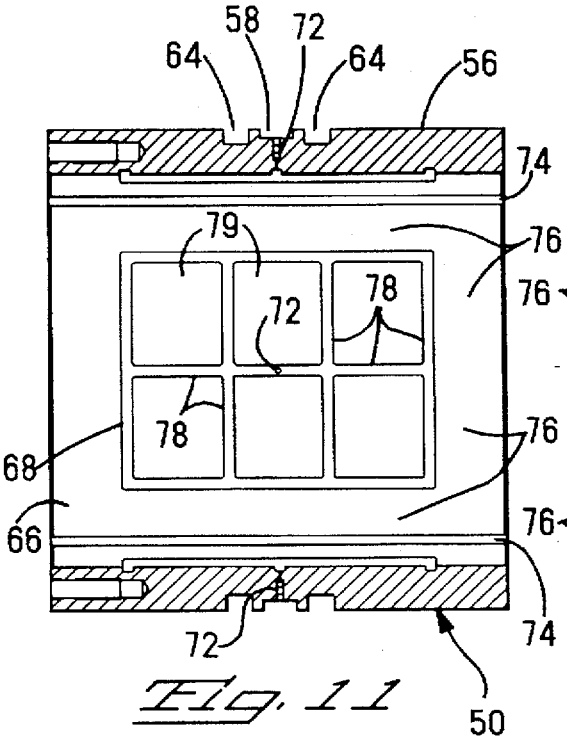
FIGS. 11 and 12 are cross-sectional views taken along the lines 11—11 and 12—12 of FIGS. 9 and 10, respectively.
Figure 12:
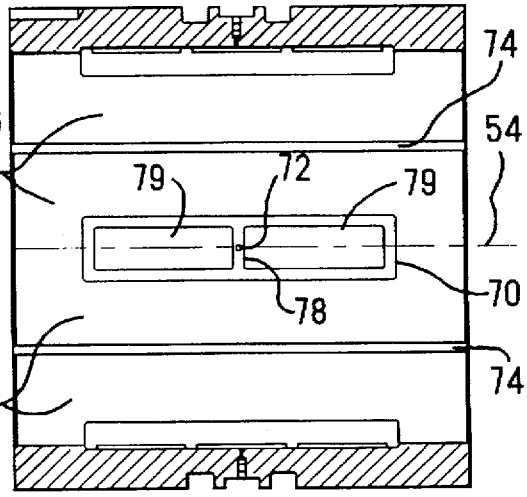

The hydrostatic bearing 50, as seen in FIGS. 7 through 10, has an outside diameter 56 that is a press fit with the bore 52. A pin 57 is disposed in a blind hole formed in the bearing 50 and the end 38 at their junction, as best seen in FIG. 7, for positioning the bearing within the bore 52 and preventing relative rotation thereof. A supply groove 58 is formed in the outside diameter 56 mid-way between the two ends, as shown in FIG. 9. The supply groove 58 is in communication with a supply passageway 60, shown in FIG. 7, formed in the connecting rod 36 that carries the high pressure hydraulic fluid that is used to supply the hydrostatic bearing. A pair of O-rings 62 are disposed in two grooves 64 that are on opposite sides of the supply groove 58 and serve to confine the high pressure hydraulic fluid. As shown in FIGS. 10, 11, and 12, there are four recesses 68 and 70, two large and two small, formed in the surface 66 of the interior diameter of the bearing 50. The two large recesses 68 are arranged vertically and the two small recesses 70 are arranged horizontally, with respect to the connecting rod 36, as viewed in FIGS. 7 and 10. The two recesses 68 are mutually diametrically opposed and the two recesses 70 are mutually diametrically opposed. An orifice 72 is in the bottom of each recess 68 and 70 that is in communication with the supply groove 58. Four return grooves 74 are formed in the surface 66 parallel to the axis 54, one groove approximately mid way between each adjacent pair of recesses 68 and 70, as best seen in FIG. 10. The portions of the surface 66 that remain between the recesses 68 and 70, and the grooves 74 form lands 76 that comprise the actual hydrostatic bearing surface between the end 38 of the connecting rod and the outer surface of the eccentric 40 during high speed rotation of the drive shaft 30. Within each recess 68 and 70 there are a number of other secondary grooves 78 formed in the surface 66 which form secondary pads 79 that lend additional support to the eccentric during low speed rotation while the drive shaft is being brought up to normal operating speed, which in the present example is 6000 RPM, or when the machine 10 is being powered down.

Figure 6:
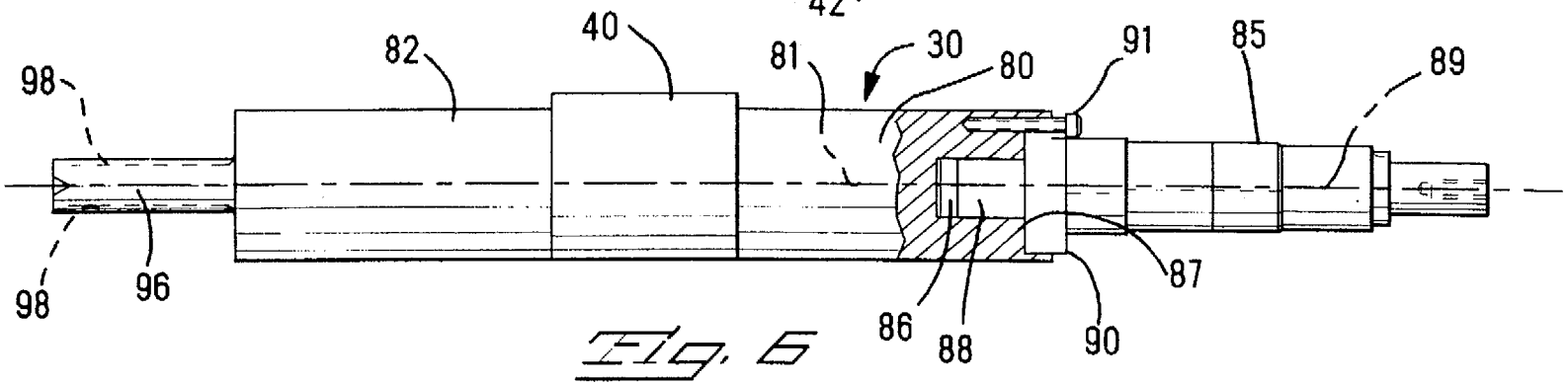
FIG. 6 is a plan view of the drive shaft of the machine.

The drive shaft 30, as shown in FIGS. 5 and 6, includes two mutually coaxial bearing diameters 80 and 82 having a common axis 81, one bearing diameter on each side of the eccentric 40, which are in hydrostatic engagement with two hydrostatic bearings 84, disposed in the frame 12. A motor shaft 85, of the motor 32, extends from the right end of the drive shaft 30 and is removably but rigidly attached thereto. A bore 86 is formed in an end 87 of the drive shaft 30 coaxial with the axis 81. The motor shaft 85 includes a pilot diameter 88 on one end thereof that is in slip fit engagement with the bore 86 and is arranged so that the axis 89 of the motor shaft is coaxial with the axis 81 of the drive shaft. A flange 90, formed integral to the motor shaft, is adjacent the pilot diameter 88 and is tightly secured against the end 87 of the drive shaft by means of several screws 91. The screws 91 are equally spaced about the flange, extending through clearance holes in the flange and into threaded holes formed in the end 87 of the drive shaft 30. The motor shaft 85 receives a motor armature 92 and is journaled in a bearing 93 located in an end cap 94 of the motor housing, as best seen in FIG. 5. The housing of the motor 32 is firmly attached to the frame 12 by means of several screws 95 that extend through clearance holes in the motor housing and into threaded holes in the frame. The bearing 93 controls the axial position of the drive shaft 30. With this arrangement the motor 32 may be easily removed and replaced with another direct drive motor. This may be useful, for example, when a motor of higher horsepower is required to operate the machine 10 for certain stamping and forming operations. A reduced diameter 96 extends from the left end of the drive shaft 30, as shown in FIGS. 5 and 6, and has a pair of oppositely formed keyways running the length of the reduced diameter. A flywheel 100 is keyed to the reduced diameter 96 by a key and keyway 98 and held in place by means of a set screw 102 in the usual manner.

Figure 3:
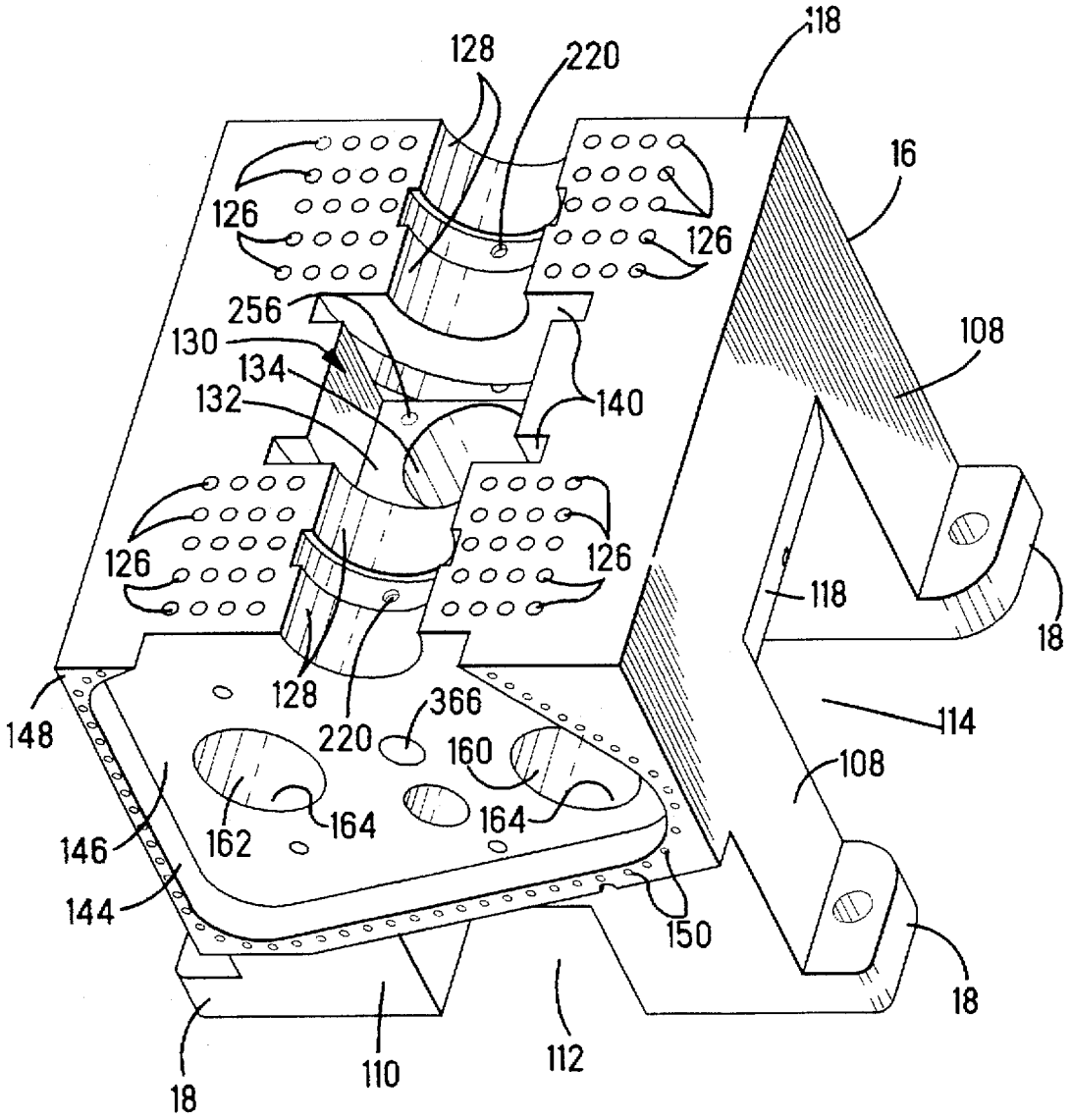
FIG. 3 is an isometric view of a portion of the frame of the machine looking downwardly from above.
Figure 4:
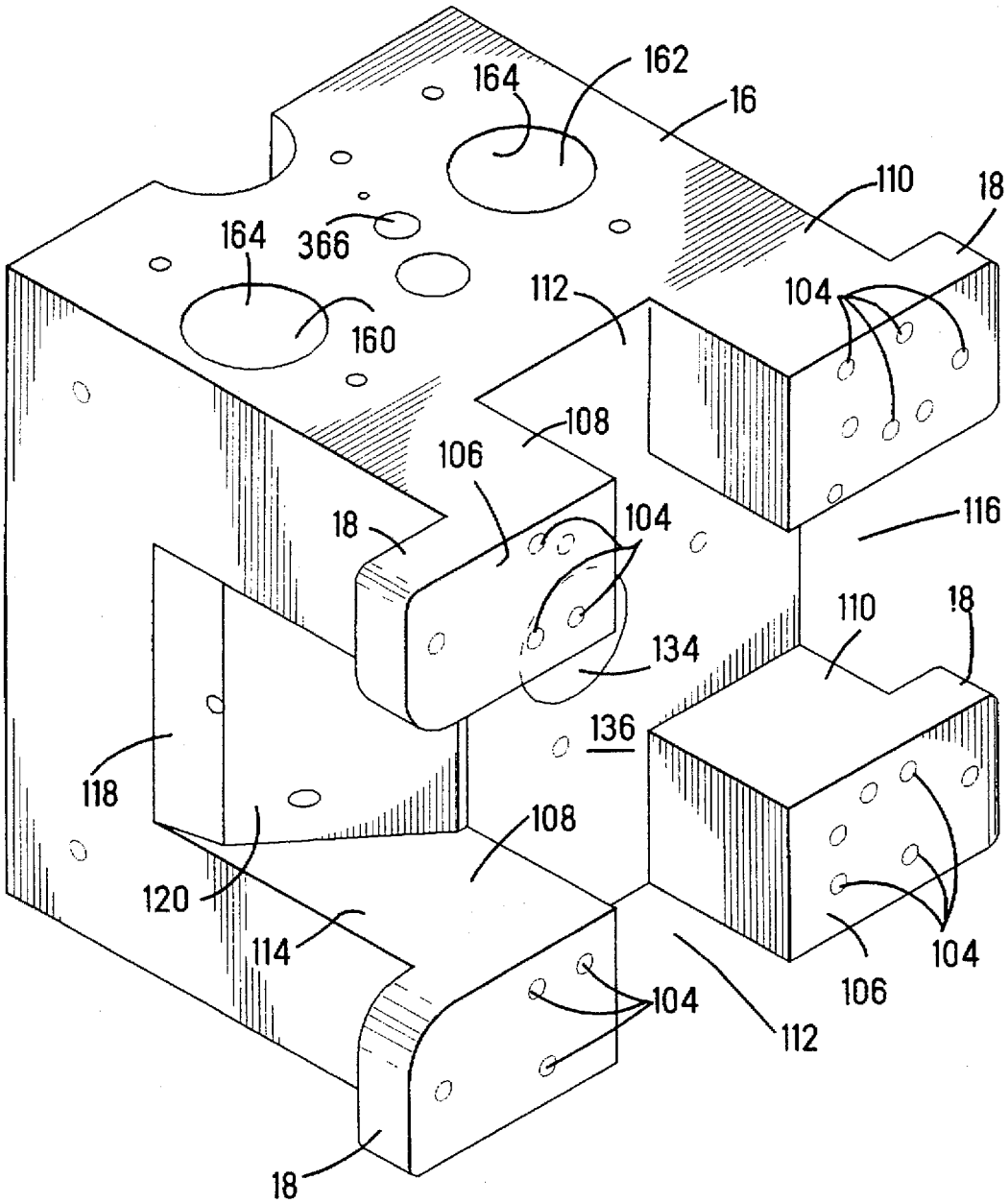
FIG. 4 is a view similar to that of FIG. 3 but looking upwardly from below.
Figure 14:
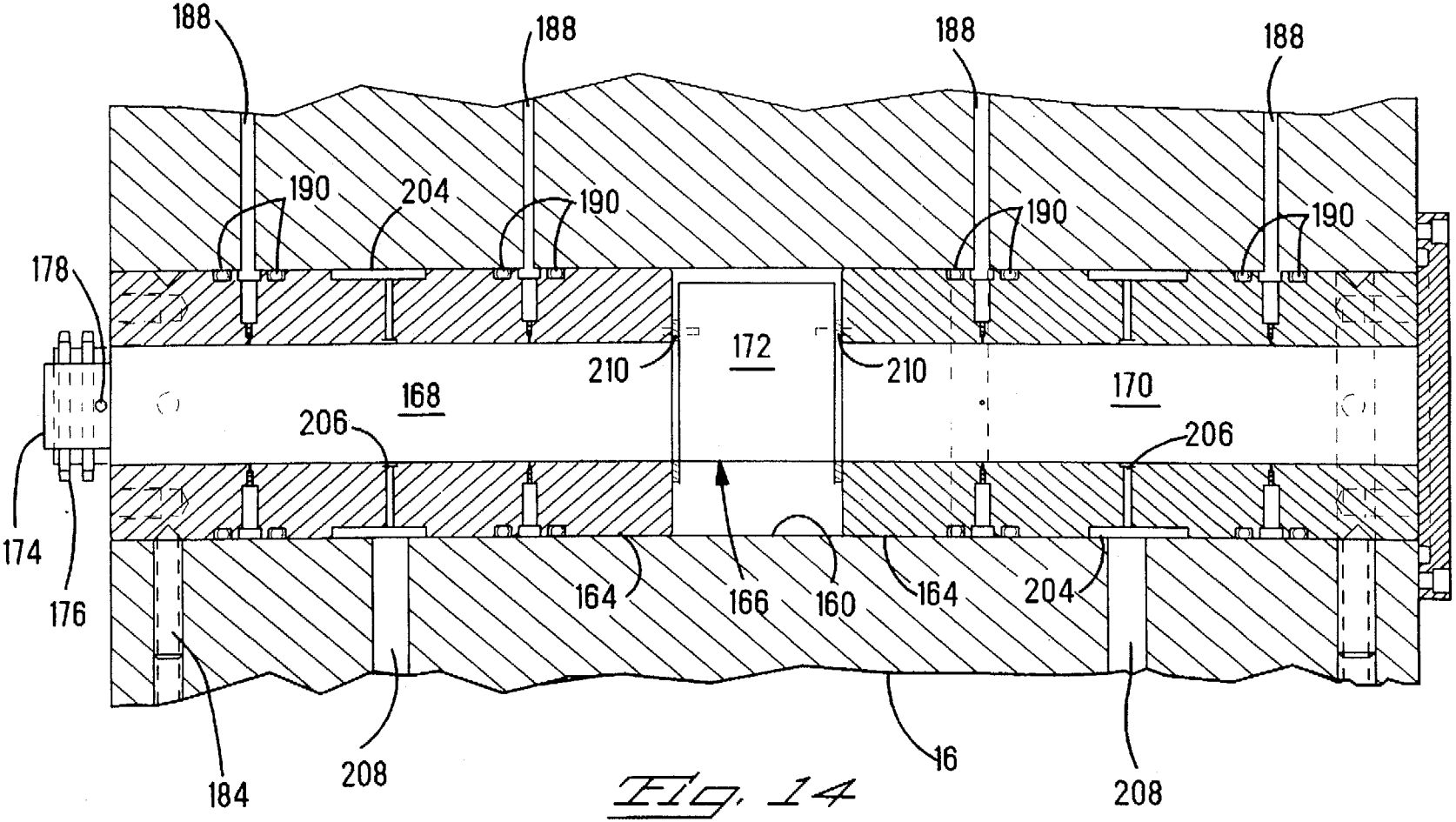
FIG. 14 is a cross-sectional view taken along the lines 14—14 in FIG. 13.

The lower frame 16, as shown in FIGS. 3 and 4, is made from a solid block of steel or cast iron and includes two front legs 108 and two rear legs 110, all of which terminate in mounting surfaces 106 and the feet 18. A series of threaded holes 104 are formed in the mounting surface 106, as best seen in FIG. 4. The mounting surfaces 106 rest on the top surface of the bolster plate 20 and the lower frame 16 bolted in place, as will be described below. The two sets of legs 108 and 110 form a strip feed opening 112 that extends the entire length of the lower frame 16. A front access opening 114 is between the two front legs 108 and a rear access opening 116 is between the two rear legs 110. Two beveled surfaces 118 and 120 between the two front legs 108 provide improved visibility and access to the tooling during set up and operation of the machine. The lower frame 16 has a top mating surface 118 that mates with a bottom mating surface 120 of the upper frame 14, as shown in FIG. 1. A main bore 128 is formed through the frame 12 so that its axis is parallel with the mating surfaces 118 and 120. The main bore 128, which extends into both the upper and lower frames 14 and 16 a similar amount, is a press fit for the hydrostatic bearings 84 and 86. The upper and lower frames are bolted together by means of bolts 122 which extend through counterbored clearance holes 124 in the upper frame 14 and into threaded holes 126 formed in the lower frame 16. The counterbores of the holes 124 are relatively deep into the upper frame 14 so that the length of the bolts 122 are minimized to reduce the affect of stretching of the bolts caused by the very high forces tending to force the upper and lower frames apart during operation of the machine. Since these forces are concentrated at the hydrostatic bearings 84 and 86, the threaded holes 126 are arranged in four clusters, one cluster adjacent and on opposite sides of each hydrostatic bearing site, as best seen in FIG. 3. A recess 130 is formed in the surface 118 of the lower frame 16, terminating in a floor 132. A bore 134 is formed into the floor 132 and extends completely through the lower frame and exits a bottom surface 136 of the lower frame. The bore 134 receives a main ram bearing 138 in the shape of a cylindrical sleeve, shown in FIG. 5, that will be explained in detail below. As with the bore 128, a pair of annular recesses 140 extend into both the upper and lower frames 14 and 16 a similar amount providing clearance for two rotating main counterweights 142 that are attached to and rotate with the drive shaft 30, as will be described in detail below. Another recess 144 having a floor 146 is formed in the right surface 148 of the frame 12 and extends into both the upper and lower frames, as shown in FIG. 5. A series of threaded holes 150 are disposed in the surface 148 along the periphery of the recess 144. A cover plate 152 that covers the entire recess 144 is secured to the surface 148 by means of screws 154 that are threaded into the holes 150. A forward bore 160 and a rearward bore 162 are formed completely through the lower frame 16, as best seen in FIGS. 3 and 4. Each bore 160, 162 contains two hydrostatic bearings 164, one bearing adjacent each end of the bore, as shown in FIG. 14. The forward and rearward bores 160 and 162 are arranged to receive substantially identical counterbalance shafts 166.

Figure 17:
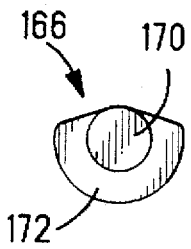
FIGS. 16 and 17 are plan and end views, respectively, of one of the two counterbalance shafts of the machine.
Figure 16:
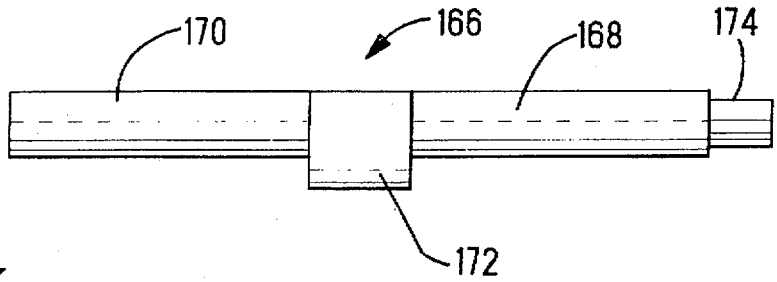
Figure 19:
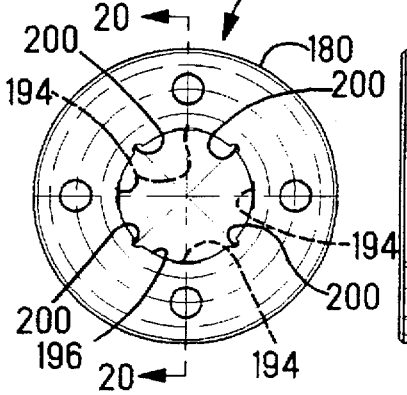
FIGS. 18 and 19 are plan and end views, respectively, of the counterbalance bearing.
Figure 18:
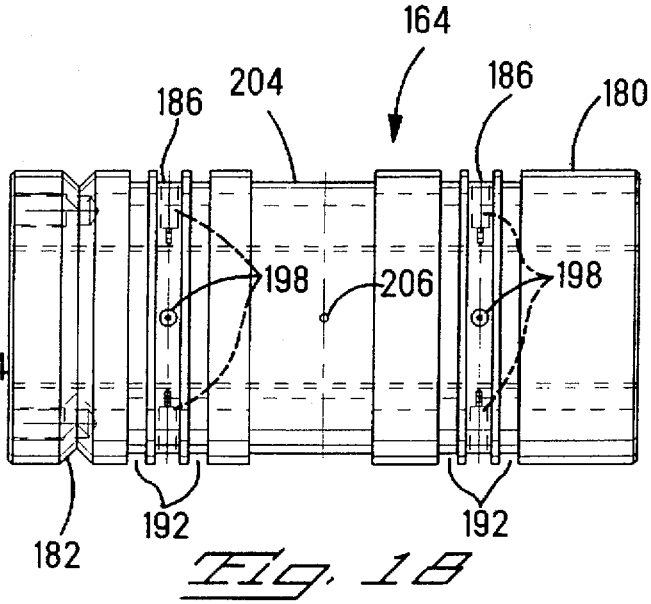
Figure 20:
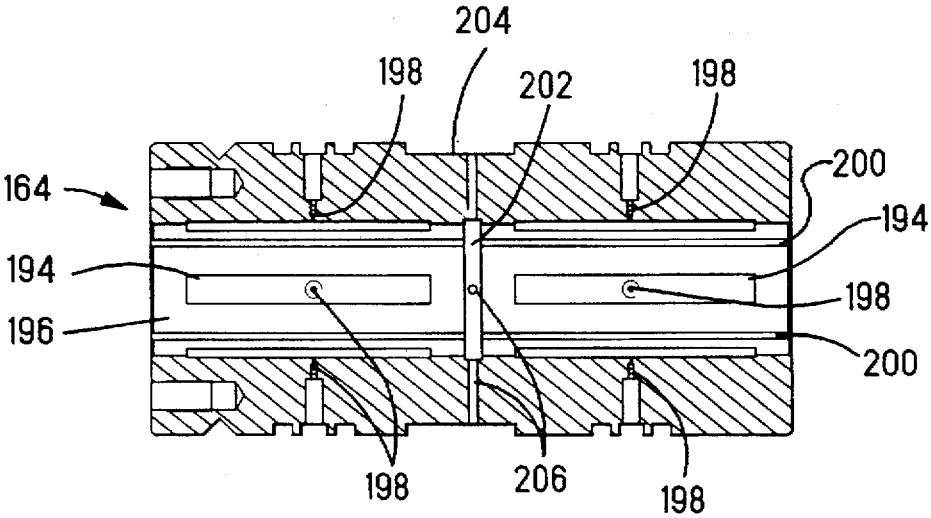
FIG. 20 is a cross-sectional view of the bearing taken along the lines 20—20 in FIG. 18.

As shown in FIGS. 16 and 17, The counterbalance shaft 166 includes two mutually coaxial diameters 168 and 170 and a counterweight 172 arranged therebetween. The counterweight 172 is arranged off center to the two bearing diameters and has a mass and moment arm product that is equal to one half of the combined mass and moment arm product of the two main counterweights 142, the eccentric 40 and the relative portion of the connecting rod 36 and bearing 50, as will be explained below. A reduced diameter 174 extends from one end of the shaft 166 for receiving a drive sprocket 176, as shown in FIG. 14, which is keyed to the shaft and secured in place by means of a set screw 178. The hydrostatic bearing 164, as seen in FIGS. 18 and 19, has an outside diameter 180 that is a light press fit with the bores 160 and 162. An annular V-groove 182 is disposed in the outside diameter 180 near one end thereof, as best seen in FIG. 18. A cone point set screw 184 is threaded into the frame 12 and tightened against the V-groove for positioning the bearing within the bore 160, 162 and preventing relative rotation thereof. Two supply grooves 186 are formed in the outside diameter 180, as shown in FIG. 18. The supply groove 186 are in communication with supply passageways 188, shown in FIG. 14, formed in the lower frame 16. A pair of O-rings 190 are disposed in two grooves 192 that are on opposite sides of each supply groove 186 and serve to confine the high pressure hydraulic fluid. As shown in FIGS. 19 and 20, there are four substantially identical recesses 194 in the interior surface 196, equally spaced about the interior diameter of the bearing 164. An orifice 198 is in the bottom of each recess 194 that is in communication with the supply groove 186. Four return grooves 200 are formed in the surface 196 parallel to the axis of the bearing 164, equally spaced about the interior diameter, between the recesses 194, as best seen in FIG. 19. An annular return groove 202 is formed in the surface 196 substantially mid way between the two ends of the bearing, intersecting the four return grooves 200. Another groove 204 is formed in the outer diameter 180 substantially mid way between the two ends of the bearing. A return hole 206 is formed Through the side of the bearing in communication with both of the grooves 202 and 204. The portions of the surface 196 that remain between the recesses 194 and the grooves 200 and 202 comprise the actual hydrostatic bearing surface of the bearing 164. A return passageway 208 is formed in the lower frame 16 in communication with each groove 204 for returning hydraulic fluid to a main sump of the hydraulic source 53. A pair of thrust washers 210 are disposed on the two diameters 168 and 170 in engagement with opposite sides of the counterweight 172, between the counterweight and the ends of the bearings 164, as shown in FIG. 14, and serve to limit axial motion of the shaft 166.

Figure 24:
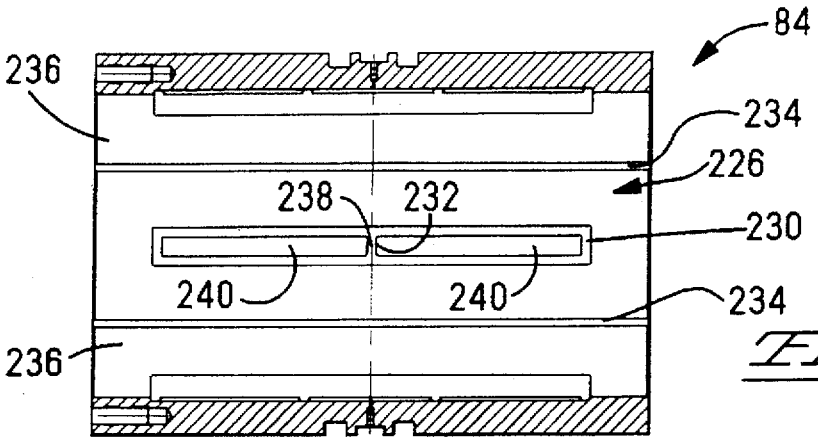
FIGS. 23 and 24 are cross-sectional views taken along the lines 23—23 and 24—24 in FIGS. 21 and 22, respectively.
Figure 23:
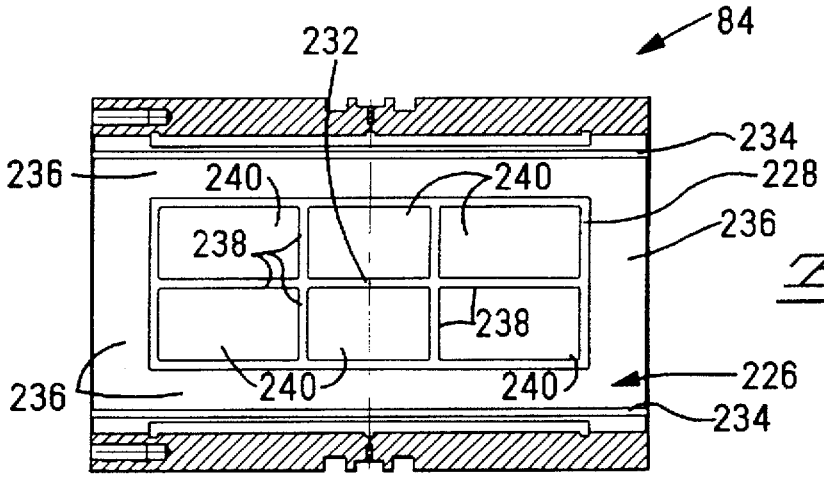
Figure 21:
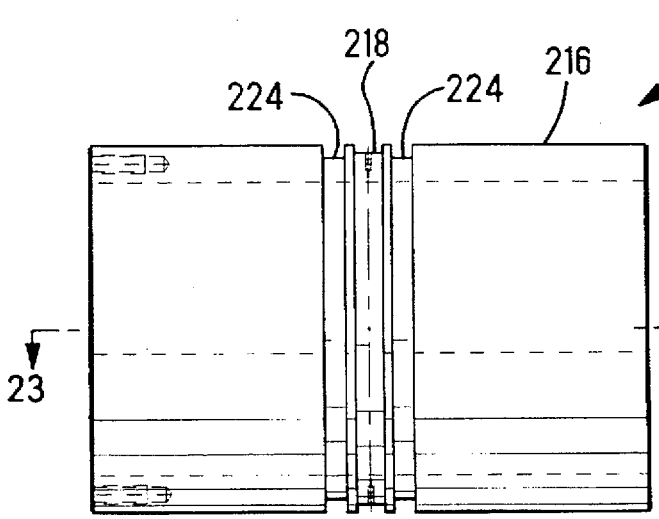
FIGS. 21 and 22 are plan and end views, respectively, of one of the drive shaft bearings.
Figure 22:
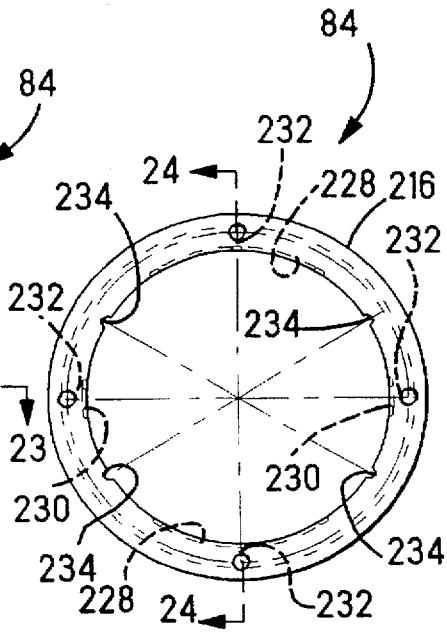

The hydrostatic bearing 84, as seen in FIGS. 5 and 21 through 24, has an outside diameter 216 that is a close fit with the main bore 128 so that the bearing is held securely within the bore and prevents relative rotation thereof. A supply groove 218 is formed in the outside diameter 216 mid-way between the two ends, as shown in FIG. 21. The supply groove 218 is in communication with a supply passageway 220, shown in FIG. 5, formed in the lower frame 16 that carries the high pressure hydraulic fluid that is used to supply the hydrostatic bearing. A pair of O-rings 222 are disposed in two grooves 224 that are on opposite sides of the supply groove 218 and serve to confine the high pressure hydraulic fluid. As shown in FIGS. 22, 23, and 24, there are four recesses, two large and two small, formed in the surface 226 of the interior diameter of the bearing 84. The two large recesses 228 are arranged vertically and the two small recesses 230 are arranged horizontally, with respect to the machine 10, as viewed in FIG. 5. The two recesses 228 are mutually diametrically opposed and the two recesses 230 are mutually diametrically opposed. An orifice 232 is in the bottom of each recess 228 and 230 that is in communication with the supply groove 218. Four return grooves 234 are formed in the surface 226 parallel to the axis of the bearing, one groove approximately mid way between each adjacent pair of recesses 228 and 230, as best seen in FIG. 22. The portions of the surface 226 that remain between the recesses 228 and 230, and the grooves 234 form lands 236 that comprise the actual hydrostatic bearing surface between the bearing 84 and the diameters 80 and 82 of the drive shaft 30 during high speed rotation of the drive shaft. Within each recess 228 and 230 there are a number of other secondary grooves 238 formed in the surface 226 which form secondary pads 240 that lend additional support to the drive shaft during low speed rotation while it is being brought up to normal operating speed, which in the present example is 6000 RPM, or when the machine 10 is being powered down.

Figure 13:
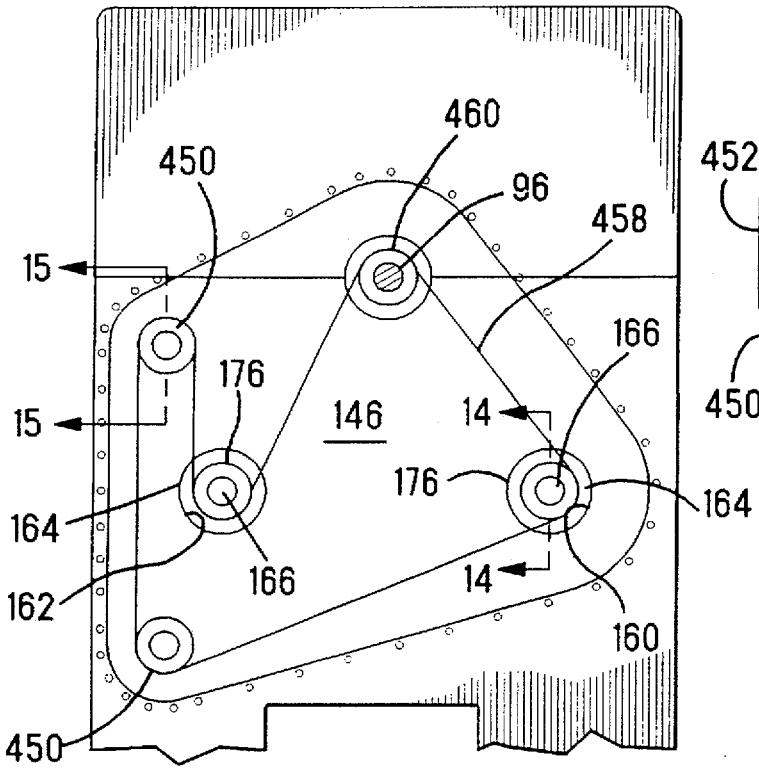
FIG. 13 is a side view of a portion of the machine shown in FIG. 2 with the cover plate removed.
Figure 15:
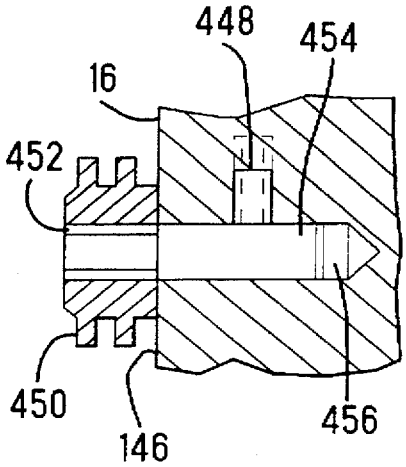
FIG. 15 is a cross-sectional view taken along the lines 15—15 in FIG. 13.

As shown in FIGS. 13 and 15, two idler sprockets 450 are journaled for rotation in the lower frame 16. Each idler sprocket 450 is journaled in a bearing 452 on the end of a shaft 454 that is secured in a blind hole 456 formed in the floor 146 of the lower frame by means of a set screw 448. A timing chain 458 is disposed around the four sprockets 176 and 450 and a drive sprocket 460 keyed to the reduced diameter 96 of the drive shaft 30.

Figure 26:
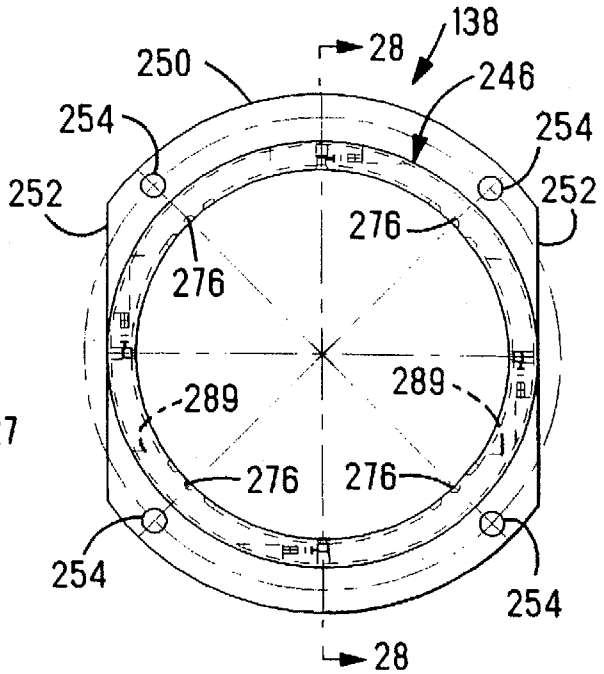
FIGS. 25 and 26 are plan and end views, respectively, of the ram bearing.
Figure 25:
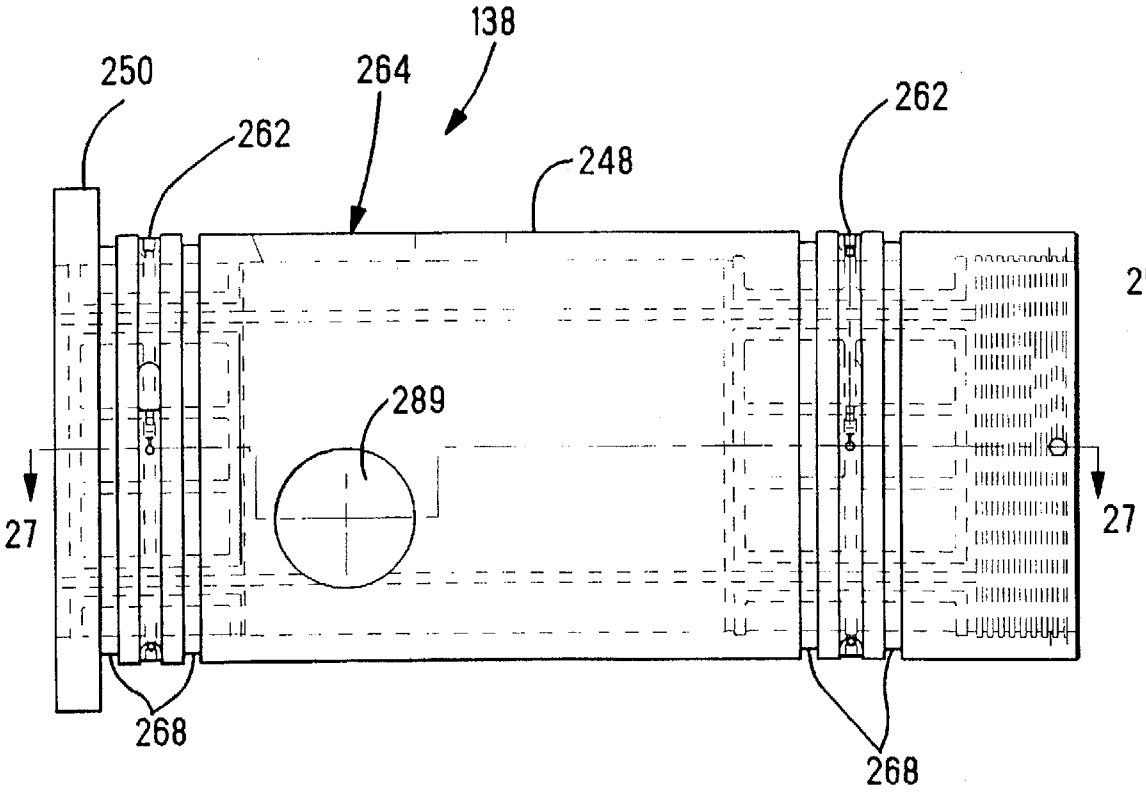
Figure 27:
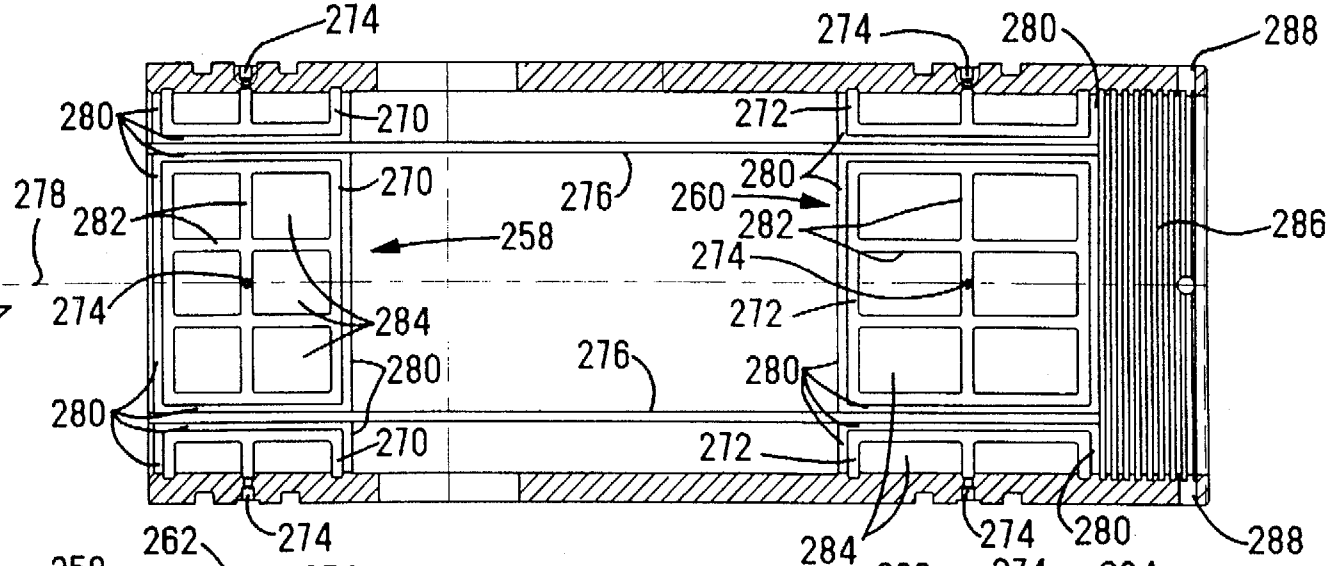
FIGS. 27 and 28 are cross-sectional views taken along the lines 27—27 and 28—28 in FIGS. 25 and 26, respectively.
Figure 28:
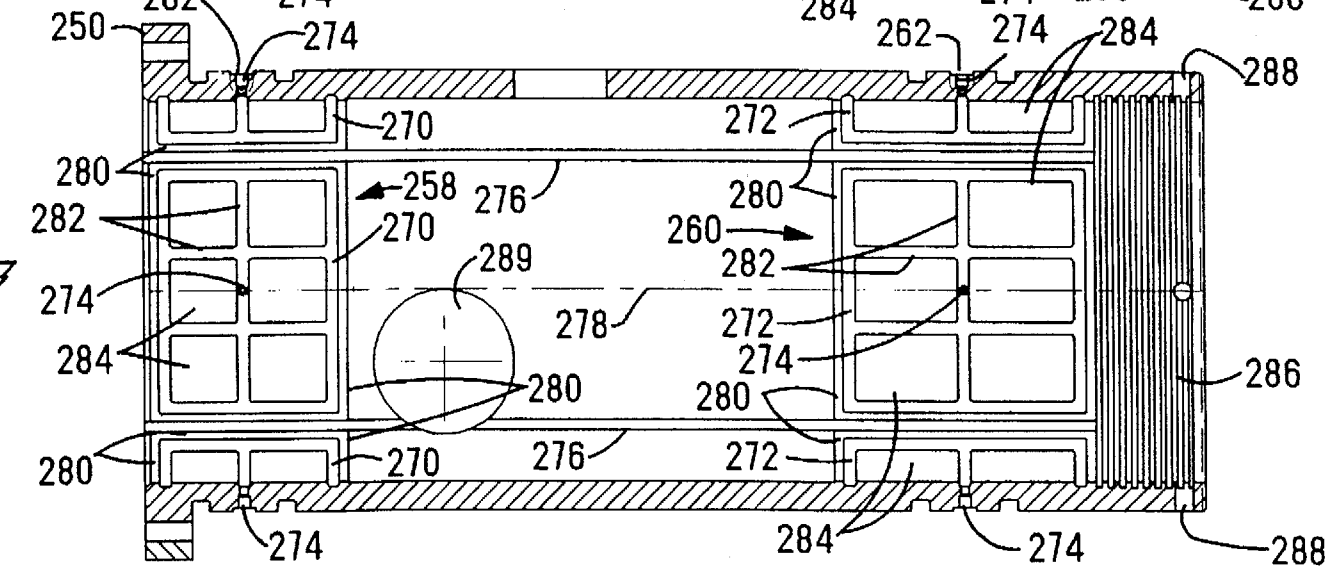
Figure 29:
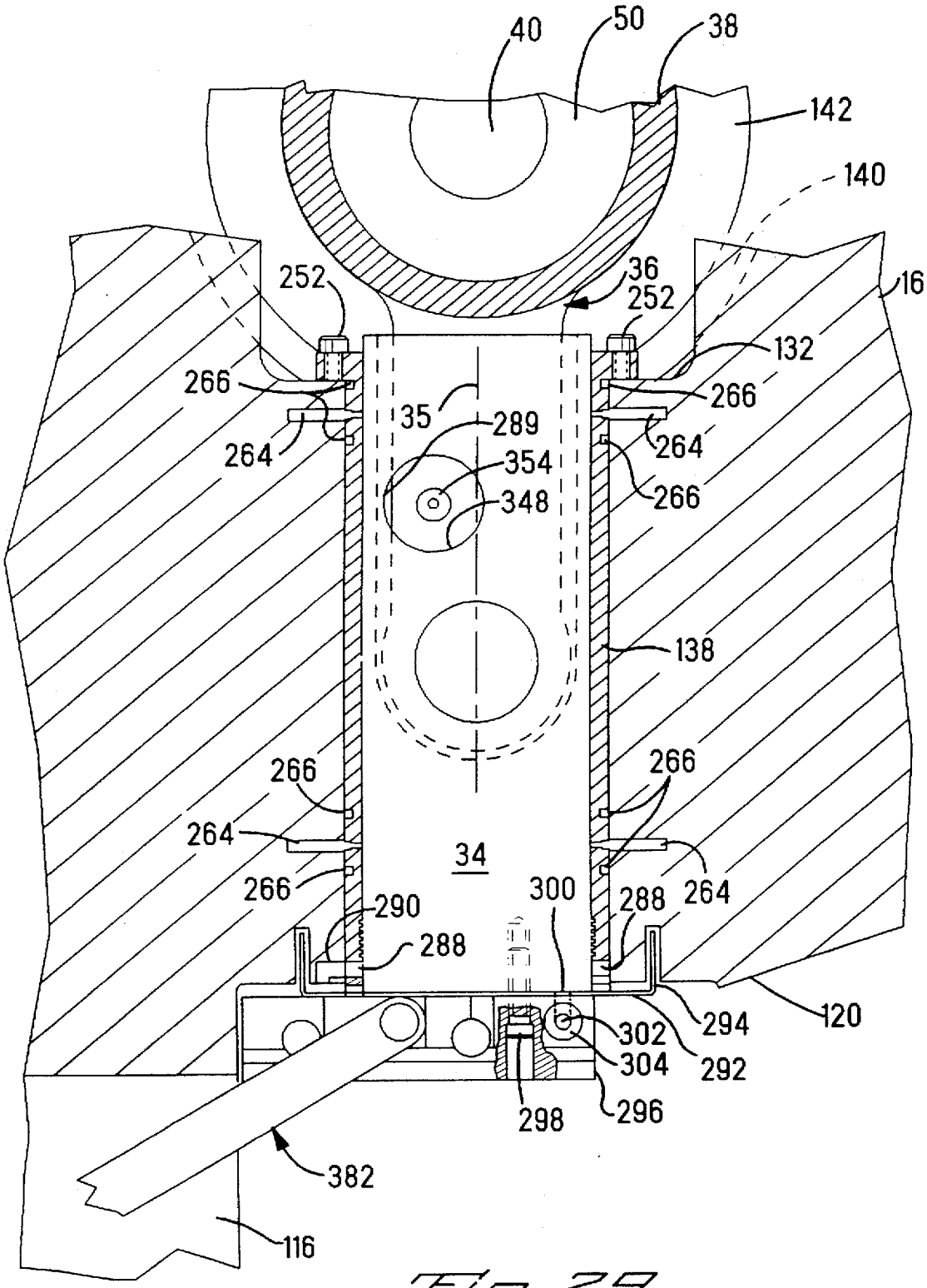
FIG. 29 is a cross-sectional view taken along the lines 29—29 in FIG. 1.

The main ram bearing 138, as shown in FIGS. 25 and 26, includes a sleeve 246 having an outer diameter 248 that is a light press fit with the bore 134 in the lower frame 16. A flange 250 having oppositely disposed flats 252 is formed on the upper end of the sleeve 246. The ram bearing 138 is disposed within the bore 134 so that the flange 250 is against the floor 132 of the recess 130. Four bolts extend through clearance holes 254 in the flange 250 and into threaded holes 256 formed in the floor 132 to secure the bearing in place. The ram bearing 138 includes an upper hydrostatic bearing 258 located in the upper end of the sleeve 246 adjacent the flange 250, and a lower hydrostatic bearing 260 located in the lower end of the sleeve adjacent the surface 136 of the lower frame 16, as seen in FIGS. 27 and 28. The sleeve 246 includes two supply grooves 262 formed in the outside diameter 248, as shown in FIG. 25, in communication with a supply passageway 264 in the lower frame 16, shown in FIG. 29, that carries the high pressure hydraulic fluid that is used to supply the hydrostatic ram bearing. Two pair of O-rings 266 are disposed in four grooves 268 that are on opposite sides of the supply grooves 262 and serve to confine the high pressure hydraulic fluid. As shown in FIGS. 25, 26, 27, and 28, the upper hydrostatic bearing 258 includes four recesses 270 in the surface of the interior diameter of the bearing sleeve 246, and the lower hydrostatic bearing 260 includes four recesses 272 in the interior surface. The four recesses 270 are equally spaced about the internal diameter, as are the four recesses 272. An orifice 274 is in the bottom of each recess 270 and 272 that is in communication with one of the supply grooves 262. Four return grooves 276 are formed in the interior diameter parallel to the axis 278 of the bearing 138, one groove approximately mid way between each adjacent pair of recesses 270 and 272, as best seen in FIGS. 26, 27, and 28. The portions of the surface of the internal diameter that remain between the recesses 270 and 272, and the grooves 276 form lands 280 that comprise the actual hydrostatic bearing surface between the bearing 138 and the outer surface of the ram 34 during high speed reciprocating motion thereof. Within each recess 270 and 272 there are a number of other secondary grooves 282 which form secondary pads 284 that lend additional support to the eccentric during low speed operation while the drive shaft is being brought up to normal operating speed, which in the present example is 6000 RPM, or when the machine 10 is being powered down. The lower hydrostatic bearing 260 has about 10 percent more land (280) area than does the upper hydrostatic bearing 258, to accommodate the higher lateral loads caused by the operational engagement of the tooling with the strip material being formed or blanked. During operation, as high pressure hydraulic fluid passes through the orifices 274 and into the recesses 270 and 272, the only way that the fluid can escape the recesses is to flow between the lands 280 and the ram 34 toward the return grooves 276. The area of the upper and lower lands 280, which in the present example are 5.751 square inches and 7.452 square inches, respectively, and the pressure of the fluid, which in the present example is about 8000 pounds per square inch, permits a lateral load of approximately 14000 pounds that the ram is capable of sustaining during operation of the machine. This is sufficient for most stamping and forming operations within the 10 ton limit of the machine 10. The lower end of the sleeve 246 includes a series of annular grooves 286 formed in the interior diameter, as best seen in FIGS. 27 and 28, which serve to buffer the hydraulic fluid passing through the return grooves 276 so that the fluid does not exit from between the ram and the end of the sleeve with too much force. As best seen in FIG. 29, the fluid passes the grooves 286 and flows into holes 288 which communicate with openings 290 in the lower frame 16, allowing the return fluid to fall downwardly due to gravity. The ram bearing 138 includes a hole 289 formed completely through the sleeve 246 for a purpose that will be explained.

A circular shaped pan 292 having a turned up edge 294 is sandwiched between the end of the ram 34 and a tool mounting block 296 to catch the return fluid. Nine spaced apart screws 298 extend through counterbored holes in the mounting block, through clearance holes in the pan, and into threaded holes in the ram to firmly secure the mounting block 296 and the pan 292 to the end of the ram 34. A drain hole 300 extends through the bottom of the pan and into intersection with a hole 302 in the side of the mounting block 296, as best seen in FIG. 29. A concave spherical seat 304 is formed in the side of the mounting block in communication with the hole 302 for receiving a mating convex spherical seat on one end of a fluid coupling 308, as shown in FIGS. 5.

Figure 30:
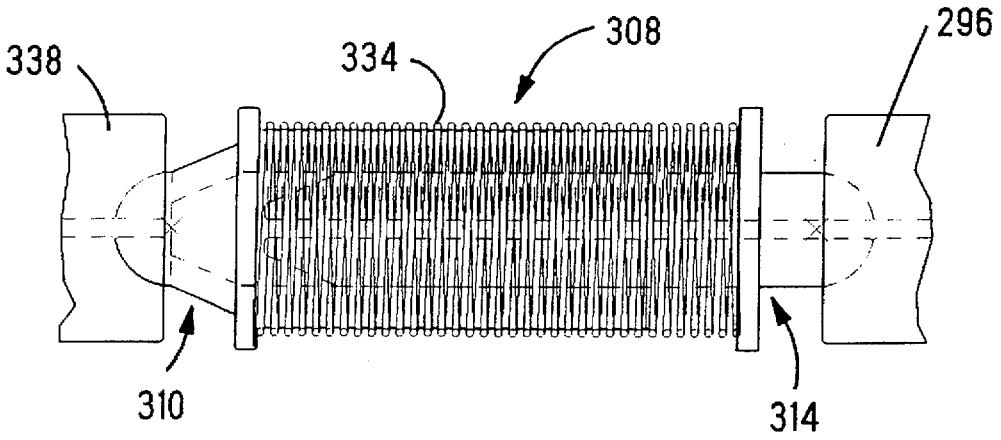
FIG. 30 is a plan view of the fluid coupling shown in FIG. 5.
Figure 31:
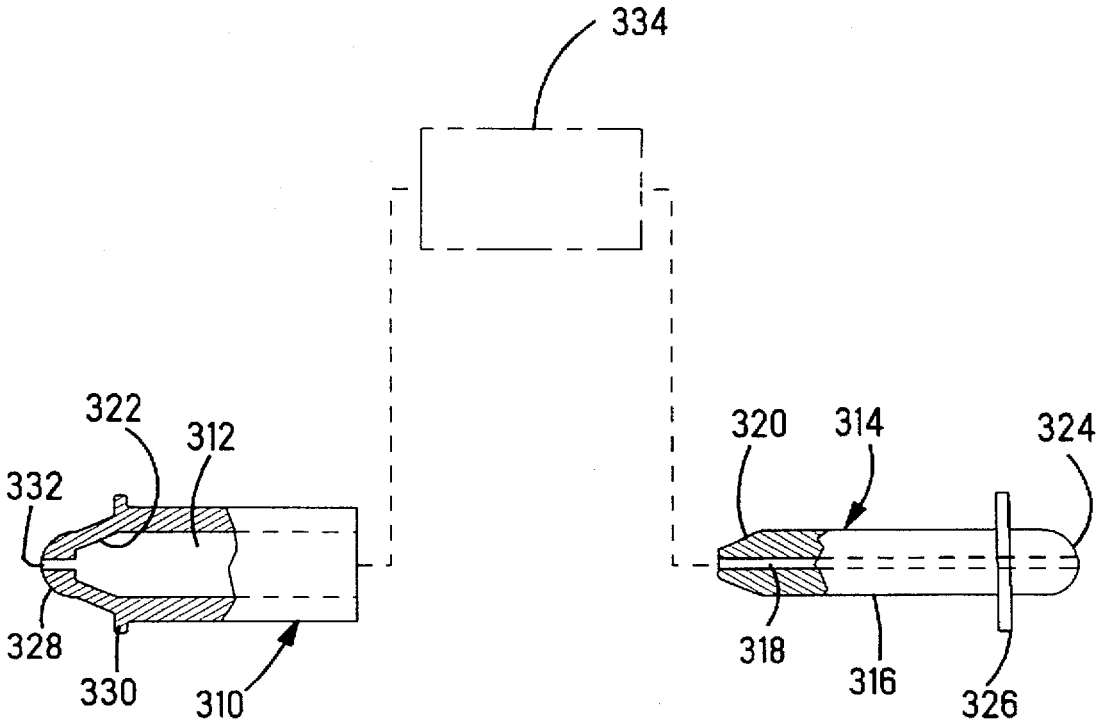
FIG. 31 is an exploded parts view of the fluid coupling shown in FIG. 30.

The fluid coupling 308, as best seen in FIGS. 30 and 31, includes a first member 310 having a bore 312 that is formed part way through the member to form a rigid cylindrically shaped wall, and a second member 314 having an outside diameter 316 that is a slip fit with the bore 312. A hole 318 extends axially completely through the second member thereby forming a rigid cylindrically shaped wall. One end 320 of the second member is tapered to conform approximately to the terminal end 322 of the bore 312, while the other end is spherical shaped to form a convex seat 324 having an area that is less than the cross-sectional area of the bore 312. This difference in areas will allow the high pressure hydraulic fluid within the fluid coupling to urge the first and second members apart, for a purpose that will be explained below. An annular flange 326 extends from the outer diameter 316 near the seat 324. The first member 310 includes a spherical shaped end forming a convex seat 328 and an annular flange 330 adjacent the seat. A hole 332 is formed through the seat 328 into the bore 312. A compression spring 334 is arranged over the first member 310 so that when the second member 314 is assembled within the bore 312, as shown in FIG. 30, the spring is compressed somewhat between the two flanges 326 and 330 and urges the two spherical seats 324 and 328 apart. The convex spherical seat 324 of the fluid coupling 308 is in seated engagement with the concave spherical seat 304 of the mounting block 296, as shown in FIG. 5. The convex spherical seat 328 at the other end of the fluid coupling is in seated engagement with a concave spherical seat 336 formed in a manifold block 338 attached to the lower frame 16 by means of screws 340. The manifold block is interconnected to a suction device at the return sump of the hydraulic source 53 so that hydraulic fluid that is returned to the pan 292 is sucked into the hole 300. through the fluid coupling 308, into the manifold block, and to the returned sump. The fluid coupling 308 is arranged so that its spring 334 maintain the coupling in seated engagement at both ends, during reciprocating motion of the ram.

Figure 32:
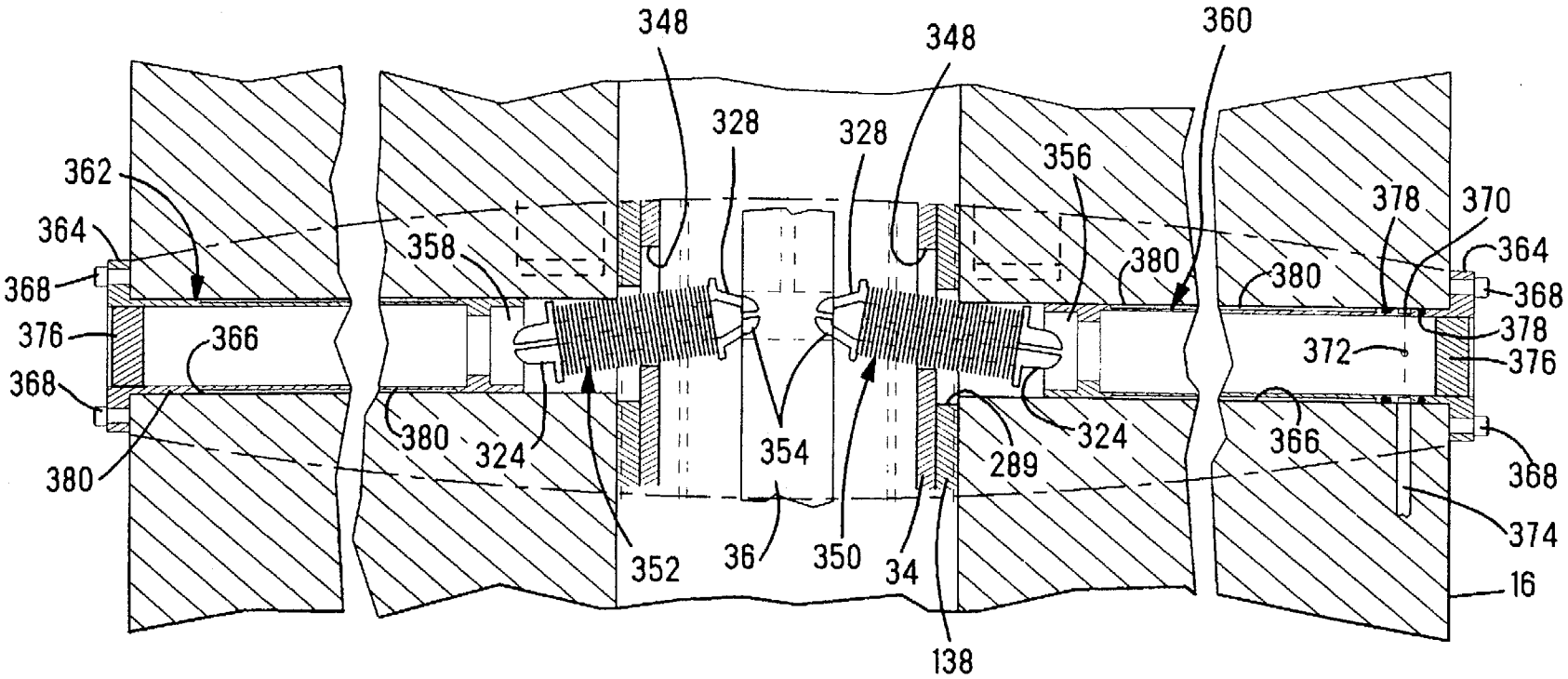
FIG. 32 is a view showing an enlarged portion of the view of FIG. 5.

There is shown in FIG. 32 a pair of fluid couplings 350 and 352, identical in all respects to the fluid coupling 308. Each fluid coupling has its convex spherical seat 328 in mated engagement with a respective concave spherical seat 354, shown in FIGS. 7 and 8, on opposite sides of the connecting rod 36 so that their respective holes 332 are in communication with the passageway 60 in the connecting rod. The fluid couplings extend through the hole 289 in each side of the ram bearing 138 and through a clearance hole 348 that is formed through the ram 34. The opposite ends of the fluid couplings 350 and 352 have their respective convex spherical seats 324 in mated engagement with concave spherical seats 356 and 358 that are in the ends of right and left hollow tubes 360 and 362, respectively, as shown in FIG. 32. The clearance hole 348 extending through the ram 34 for the fluid couplings is important because this permits a longer ram than would otherwise be possible thereby providing relatively more dynamic stability to the reciprocating ram. Each of the tubes 360 and 362 has a flange 364 at the end opposite the spherical seats. As shown in FIGS. 3 and 4, a bore 366 extends completely through the lower frame 16 just below the bore 128. The right tube 360 is in the right end of the bore 366 and the left tube is in the left end of the bore 366 so that their respective flanges 364 are against the right and left sides of the lower frame 16, as shown in FIG. 32. Screws 368 extend through clearance holes in the flanges and into threaded holes in the lower frame to secure the tubes in place. The right tube 360 includes an annular supply grove 370 adjacent its flanged end and a hole 372 through the wall so that the groove is in communication with the interior of the tube. A supply passageway 374, interconnected to the high pressure hydraulic fluid system 53, is in communication with the supply groove 370 so that high pressure hydraulic fluid is provided to the interior of the tube 360. Since the two fluid couplings are in communication with the passageway 60 via the seats 354 in the connecting rod 36, the high pressure hydraulic fluid is present in the interior of the tube 362 and the hydrostatic bearing 50. The left end of the left tube 362 is terminated with a plug 376. A pair a O-rings 378 are arranged in annular grooves on either side of the supply groove 370 to retain the high pressure hydraulic fluid. The fluid couplings 350 and 352 are arranged so that their springs 334 maintain the couplings in seated engagement at both ends, while the machine is not running. However, during operation of the machine while the ram is undergoing reciprocating motion, the pressure of the high pressure hydraulic fluid within each fluid coupling will urge the first and second members 310 and 314 apart so that their convex spherical seats 328 are in mated engagement with respective concave spherical seats 354 on opposite sides of the connecting rod 36, and their convex spherical seats 324 are in mated engagement with respective concave spherical seats 356 and 358, shown in FIG. 32. Each tube 360 and 362 has an outer diameter that is a slip fit with the bore 366 near the two ends of the tube and a reduced diameter in the central section therebetween yielding a substantially long thin wall section 380 of the tube. This thin wall section 380 is spaced from the bore 366 and is arranged to elastically expand and contract slightly as the local pressure of the hydraulic fluid increases and decreases. This occurs as the two parts of the fluid couplings 350 and 352 telescope under the reciprocating motion of the ram 34, thereby rapidly changing the internal volume of the fluid couplings. Because these volume changes occur so rapidly, there is insufficient time for the fluid to react and equalize the pressure throughout the system. Therefore, the tubes 360 and 362 are arranged to expand and contract to absorb this volume change that occurs within the fluid couplings.

Figure 34:
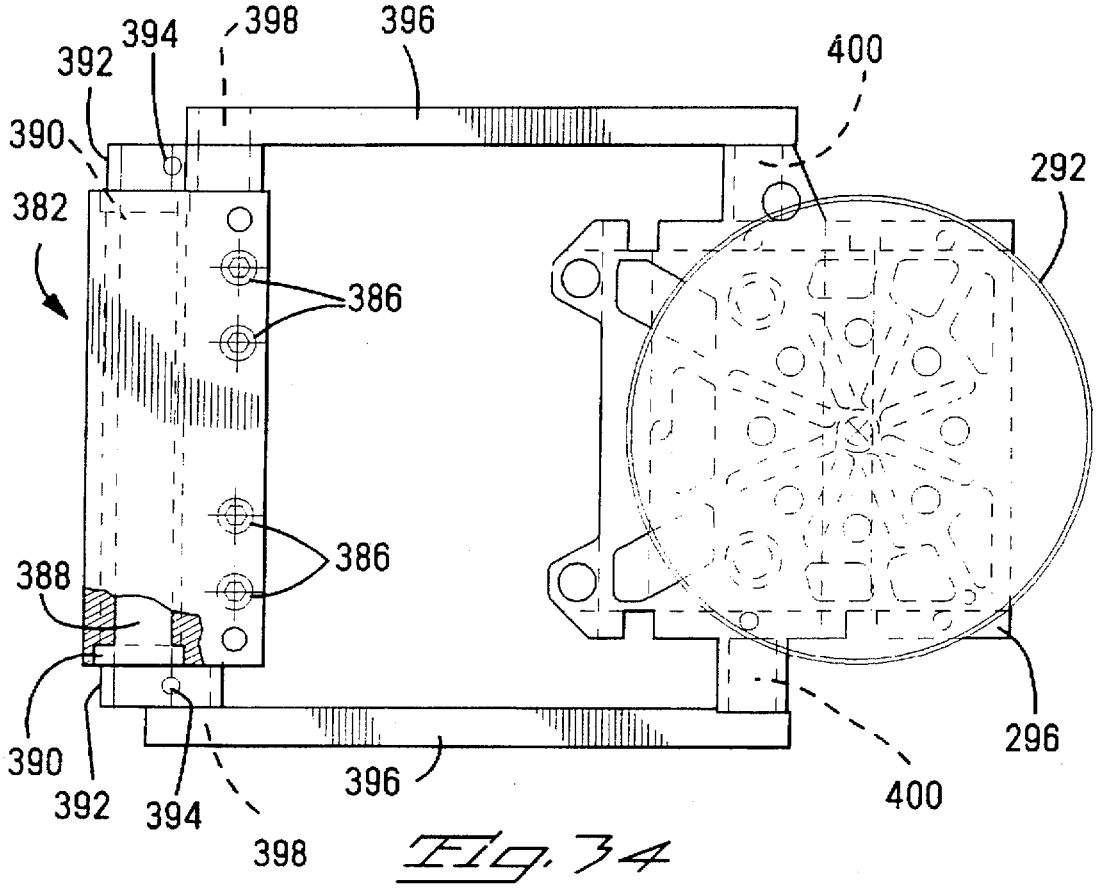
FIGS. 33 and 34 are front and top views, respectively, of the ram anti-rotation mechanism in the machine shown in FIG. 1.
Figure 33:
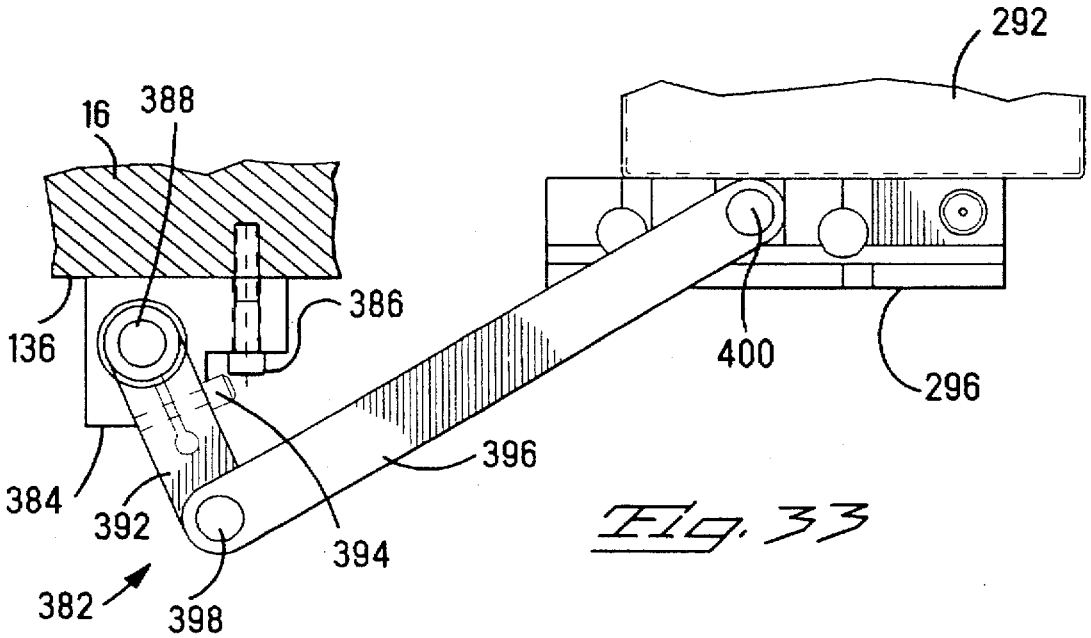

There is shown in FIGS. 33 and 34 an anti-rotation mechanism 382 having a pillow block 384 attached to the surface 136 of the lower frame 16 by means of four screws 386. A shaft 388 is journaled in a pair of roller bearings 390 in the pillow block so that the axis of the shaft is perpendicular to the ram axis 35. A link 392 is clamped to each end of the shaft 388 by means of a screw 394 that is threaded into a split end of the link, to form a rigid assembly of the shaft and two links. Two relatively longer links 396 are pivotally attached at 398 to the other ends of the two links 392 and to opposite sides of the tooling mounting block 296 at 400. The pivotal attachments at 398 and 400 are effected with a frictionless, precision bearing such as those manufactured by Lucas Aerospace Power Transmission Corporation under the trade name FREE-FLEX PIVOT bearings. It is important that bearings having substantially no friction are used here because the amount of pivotal movement is so small that races of conventional bearings will erode and rapidly deteriorate. Additionally, the bearings must be of sufficient precision to maintain the mounting block 296 in its desired angular position within 0.0000716 degrees, during reciprocation of the ram 34. Such precision will maintain the end of a 4.0 inch moment arm extending outwardly from the center of the ram to within 0.000005 inch total movement, sufficient to maintain working alignment between the first and second tooling.

Figure 35:
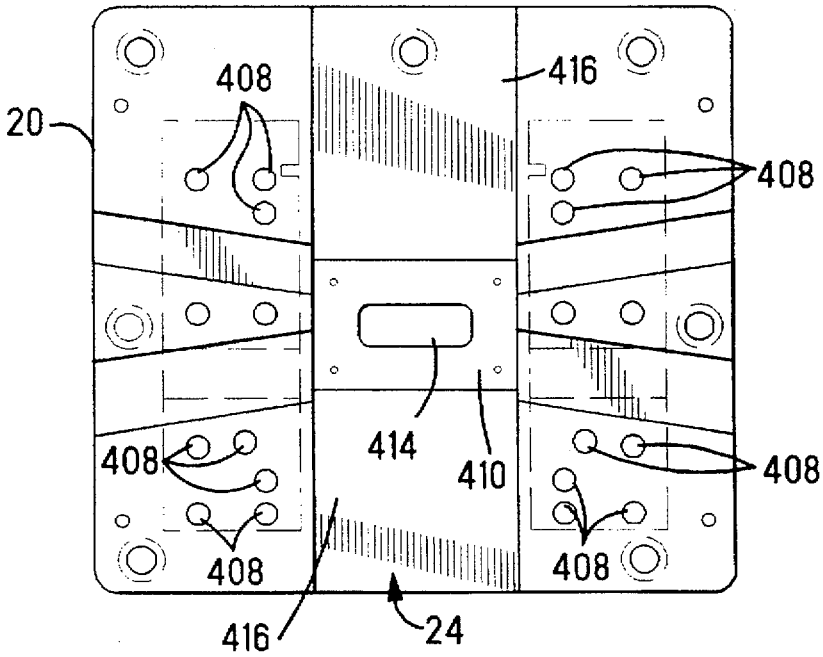
FIG. 35 Is a cross-sectional view taken along the lines 35—35 in FIG. 1.

As shown in FIGS. 1, 2, and 35, the bolster plate 20 includes a support structure 24 that is embedded in concrete 26 to form a rigid vibration dampening base 28. Several clearance holes 408 are formed through the bolster plate, as best seen in FIG. 35, in alignment with the several clearance holes 104 in the bottom of the frame 12. Bolts 105 extend through the clearance holes 408 and into tight threaded engagement with the holes 104 in the frame 12 for securing the frame to the bolster plate. The support structure 24 includes a central member 410 that extends from the bottom of the bolster plate 20 downwardly, as viewed in FIGS. 1 and 2, and terminates in an opening 412 in the concrete 26. The bolster plate 20 and central member 410 include a rectangular shaped opening 414 extending vertically, completely through both the bolster plate and the central member so that scrap slugs from stamping operations can fall into the opening 412 and be collected. Two wide gussets 416 extend from the two opposite sides of the central member 410 and the under side of the bolster plate while two pair of narrow gussets 418 and 420 extend from the other two opposite sides of the central member and the under side of the bolster plate, as best seen in FIG. 35. The bolster plate 20, the central member 410, the two wide gussets 416, and the two pair of narrow gussets 418 and 420 are all formed integrally by casting or by machining from a single block of steel. This integral structure substantially dampens vibrations caused by the tooling impacting on the strip material that is being blanked and formed during operation of the machine 10. While deflection of a conventional bolster plate in a 10 ton machine can be as high as 0.007 inch, deflection of the present bolster plate 20 is realistically unmeasurable. This dampening of vibrations substantially reduces tool wear and noise, and very importantly, it substantially reduces the elasticity of the machine so that the end point of tool position is no longer speed dependant.

Figure 36:
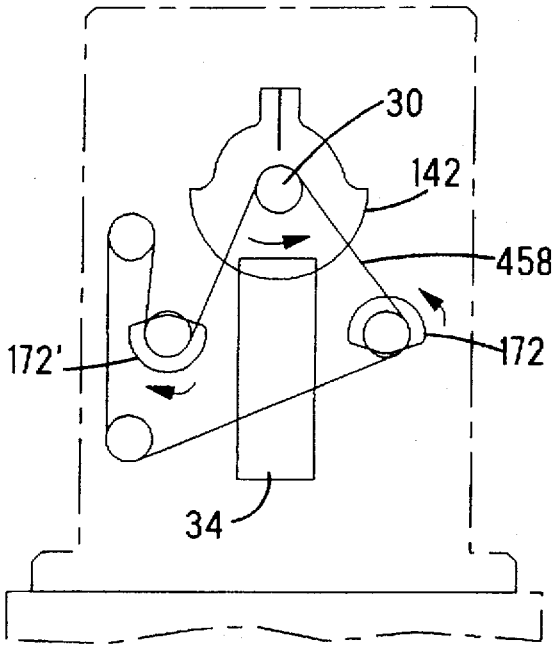
FIGS. 36 through 39 are schematic representations showing the timed relationship of the reciprocating ram and the counterbalance weights.
Figure 37:
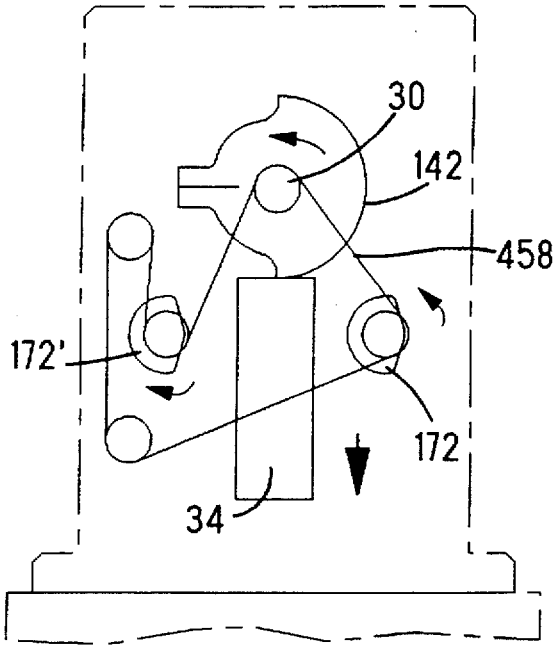
Figure 38:
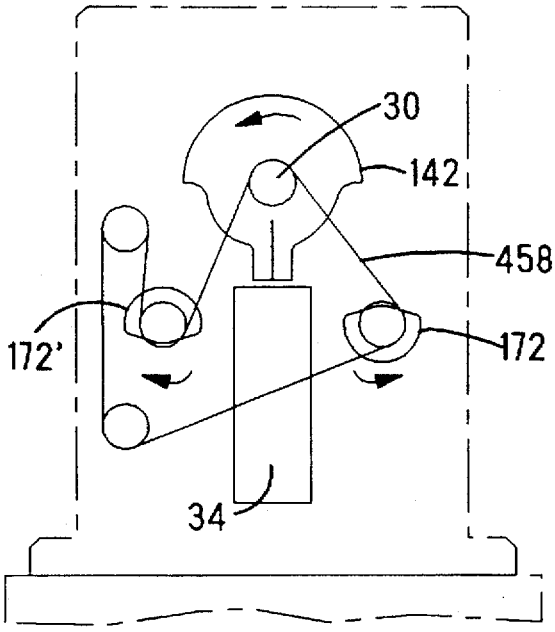
Figure 39:
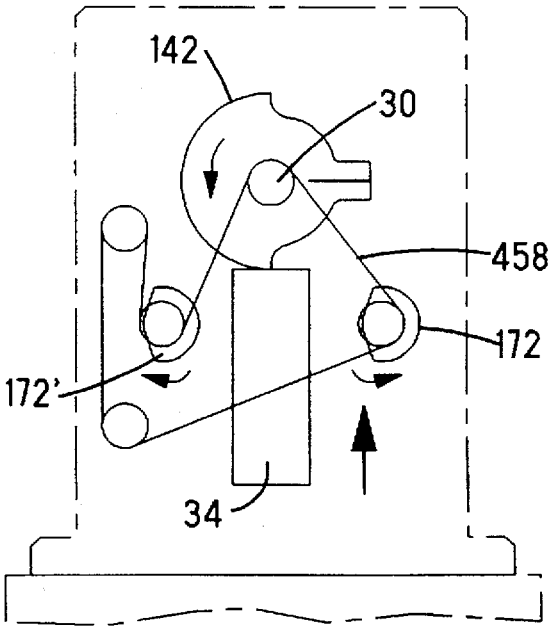

The operation of the counterweights 142 and 172 is illustrated in FIGS. 36 through 39 with the counterweight in the forward bore 160 identified as 172 and the counterweight in the rearward bore 162 identified as 172'. As shown in FIG. 36, the ram 34 is in its fully upward position with the main counterweight 142 in its fully downward or six o'clock position thereby canceling the effects of the combined weight of the ram 34, attached tooling, eccentric 40, and a portion of the connecting rod 36. The secondary counterweights 172 and 172' are facing in opposite directions so that the effects of their weights is canceled. As the drive shaft rotates counterclockwise, and the ram moved downwardly to the position shown in FIG. 37, the main counterweight 142 has moved to its three o'clock position while the secondary counterweights 172 and 172' have moved to their nine o'clock positions, thereby canceling the effects of the main counterweight 142 in the horizontal plane. As the drive shaft continues to rotate counterclockwise, and the ram moves down to its lowest position shown in FIG. 38, the main counterweight 142 has moved to its twelve o'clock position, canceling the effects of the weight of the ram, attached tooling, eccentric, and a portion of the connecting rod. The secondary counterweights are again facing in opposite directions so that they balance each other. As the drive shaft continues to rotate counterclockwise, the ram moves upwardly to the position shown in FIG. 39, the main counterweight 142 has moved to its nine o'clock position while the two secondary counterweights 172 and 172' have moved to their three o'clock positions, thereby canceling the effects of the main counterweight in the horizontal plane. As was set forth above, the total mass of the secondary counterweights 172 and 172' times their moment arms is substantially equal to the sum of the mass times the moment arm of each of the ram, attached tooling, eccentric, and relevant portion of the connecting rod. In the present example, the ram 34, connecting rod 36, and tool mounting block 296 are made from titanium to reduce the total mass of the reciprocating parts. This permits the main counterweight and the secondary counterweights to be correspondingly lighter and compact.

It will be appreciated by those skilled in the art that the present ram bearing 138 maintains the ram 34 in precise vertical alignment. The anti-rotation mechanism 382 permits vertical reciprocation of the ram 34 within the ram bearing, yet prevents any substantial angular movement of the ram. This permits precision alignment of tooling attached to and carried by the ram 34 with respect to mating tooling attached to the bolster plate 20 so that guide posts that are necessary with conventional stamping and forming machine tooling are not needed.

An important advantage of the present invention includes the capability of sustaining high speed stamping and forming operations. This permits the stamping and forming of harder materials without the need for secondary heat treat operations. Additionally, the machine is capable of operating at 6000 ram strokes per minute without the adverse effects of overheated bearings. Machine vibration is controlled to limit tool wear and reduce objectionable noise. The machine is sufficiently rigid so that precision tooling for forming and coining operations can be accommodated at various machine speeds.

I claim:

1. A high speed machine for performing stamping and forming operations on strip material at a speed of up to 6000 strokes per minute, said machine having:

(a) a frame;

(b) a drive shaft journaled in said frame;

(c) a base plate attached to said frame for holding first tooling;

(d) a ram arranged to undergo reciprocating motion within a ram bearing in said frame toward and away from said base plate along a ram axis, and to carry second tooling for mating with said first tooling for performing said stamping and forming operations;

(e) a connecting rod having a first end coupled to said drive shaft by means of an eccentric coupling and a second end pivotally coupled to said ram so that upon rotation of said drive shaft said connecting rod causes said ram to undergo said reciprocating motion;

(f) a source of high pressure hydraulic fluid; and (g) an upper hydrostatic bearing and a lower hydrostatic bearing coupling respective upper and lower portions of said ram to said ram bearing and interconnected to said source of high pressure hydraulic fluid, wherein said upper and lower hydrostatic bearings include an upper bearing surface and a lower bearing surface, respectively, formed in said ram bearing, both of which are conformably shaped to said respective upper and lower portions of said ram with a first specific amount of clearances space therebetween, each said upper and lower bearing surfaces having a plurality of similar sized spaced return grooves disposed therein parallel to said ram axis thereby forming a plurality of bearing lands, one bearing land between each pair of adjacent return grooves, each bearing land having a recess formed therein and each recess including a port in communication with said source of high pressure hydraulic fluid so that hydraulic fluid under high pressure fills said recesses and said first clearance space.

2. The machine according to claim 1 wherein said ram is cylindrical in shape having a diameter of between about 3.00 inches and about 7.00 inches.

3. The machine according to claim 2 including an alignment mechanism coupled only to said ram and said frame and arranged to maintain said first and second tooling in precise angular alignment wherein said alignment mechanism includes a first portion rigidly attached to said frame, a second portion rigidly attached to said ram, and an alignment coupling between said first and second portions that limits movement of said second portion with respect to said first portion to only linear movement.

4. The machine according to claim 3 wherein said alignment coupling comprises a pair of first substantially identical links and a pair of second substantially identical links, one end of each of said first links being rigidly attached to opposite ends of a shaft, said shaft being pivotally attached to said first portion to form a first pivotal attachment perpendicular to said ram axis, and one end of each of said second links being pivotally attached to opposite ends of said second portion to form coaxial second pivotal attachments, said first and second pivotal attachments having mutually parallel axes, wherein the other end of each of said second links is pivotally attached to the other end of a respective one of said first links.

5. The machine according to claim 1 wherein said ram has a diameter of about 4.00 inches and wherein said bearing lands of said upper bearing surface have a total surface area of about 23.00 square inches and said bearing lands of said lower bearing surface have a total surface area of about 28.80 square inches.

6. The machine according to claim 5 wherein said ram bearing is a cylindrically shaped sleeve disposed in a bore in said frame so that the axis of said sleeve is coaxial with said ram axis, said sleeve having a flange on one end thereof attached to said frame.

7. A high speed machine for performing stamping and forming operations on strip material at a speed of up to 6000 strokes per minute, said machine having:

(a) a frame;

(b) a drive shaft journaled in said frame;

(c) a base plate attached to said frame for holding first tooling;

(d) a ram arranged to undergo reciprocating motion within a ram bearing in said frame toward and away from said base plate along a ram axis, and to carry second tooling for mating with said first tooling for performing said stamping and forming operations;

(e) a connecting rod having a first end coupled to said drive shaft by means of an eccentric coupling and a second end pivotally coupled to said ram so that upon rotation of said drive shaft said connecting rod causes said ram to undergo said reciprocating motion;

(f) a source of high pressure hydraulic fluid; and (g) an upper hydrostatic bearing and a lower hydrostatic bearing coupling respective upper and lower portions of said ram to said ram bearing and interconnected to said source of high pressure hydraulic fluid, wherein said first end of said connecting rod is coupled to said eccentric by means of a first hydrostatic bearing and said second end of said connecting rod includes a wrist pin attached thereto, said wrist pin being journaled in said ram, said first hydrostatic bearing interconnected to said source of high pressure hydraulic fluid by means of a fluid coupling, wherein each of said ram and said ram bearing have a clearance opening therethrough and wherein said fluid coupling extends through said clearance openings.

8. The machine according to claim 7 including an expansion member having a chamber, a wall of said chamber being resilient, and two spaced apart openings in said expansion member in communication with said chamber, wherein said fluid coupling is in communication with one of said two openings and the other of said two openings is in communication with said source of high pressure hydraulic fluid.

9. A high speed machine for performing stamping and forming operations on strip material at a speed of up to 6000 strokes per minute, said machine having:

(a) a frame;

(b) a drive shaft journaled in said frame;

(c) a base plate attached to said frame for holding first tooling;

(d) a ram arranged to undergo reciprocating motion within a ram bearing in said frame toward and away from said base plate along a ram axis, and to carry second tooling for mating with said first tooling for performing said stamping and forming operations;

(e) a connecting rod having a first end coupled to said drive shaft by means of an eccentric coupling and a second end pivotally coupled to said ram so that upon rotation of said drive shaft said connecting rod causes said ram to undergo said reciprocating motion;

(f) a source of high pressure hydraulic fluid; and (g) an upper hydrostatic bearing and a lower hydrostatic bearing coupling respective upper and lower portions of said ram to said ram bearing and interconnected to said source of high pressure hydraulic fluid, wherein said first end of said connecting rod is coupled to said eccentric by means of a first hydrostatic bearing and said second end of said connecting rod includes a wrist pin attached thereto, said wrist pin being journaled in said ram, said first hydrostatic bearing interconnected to said source of high pressure hydraulic fluid by means of a fluid coupling including a portion having rigid walls, one end of said portion being pivotally attached to said frame and the other end of said portion being pivotally attached to said connecting rod, said first hydrostatic bearing and said fluid coupling arranged so that said drive shaft can rotate said eccentric, with respect to said connecting rod, at a speed of up to 6000 revolutions per minute.

10. The machine according to claim 9 wherein said fluid coupling comprises:

(a) a first member having a bore in one end thereof, the other end having a spherically shaped convex surface, and a first hole formed into said spherically shaped convex surface in communication with said bore; and (b) a second member having an outer diameter on one end thereof that is a slip fit with said bore, the other end having a spherically shaped convex surface, and a second hole formed into said spherically shaped convex surface through said second member and through said one end, said one end being in slip fit engagement with said bore of said first member so that said second hole is in communication with said first hole, wherein said machine includes:

(c) a first seat having a spherically shaped concave surface associated with said frame having a third hole formed therethrough in communication with said source of high pressure hydraulic fluid, said spherically shaped convex surface of one of said first and second members being in fluid sealing seated and pivotal engagement with said spherically shaped concave surface of said first seat; and (d) a second seat having a spherically shaped concave surface on said connecting rod and having a fourth hole formed thereinto in communication with said first hydrostatic bearing, said spherically shaped convex surface of the other of said first and second members being in fluid sealing seated and pivotal engagement with said second seat, so that said first hydrostatic bearing is in communication with said source of high pressure hydraulic fluid through said fluid coupling, whereby, as said ram undergoes said reciprocating motion said high pressure hydraulic fluid within said fluid coupling urges said first and second members in opposite directions so that said spherically shaped ends are urged into said seated engagement with their respective first and second spherical seats, and said first and second members telescope together to maintain said seated engagement.

11. The machine according to claim 10 wherein said fluid coupling includes an extension spring associated therewith arranged to urge said first and second members in opposite directions away from each other.

12. The machine according to claim 11 wherein said bore of said first member has a cross-sectional area that is larger than the area of said spherically shaped convex surface of said second member.

13. The machine according to claim 10 wherein said second seat is on one side of said connecting rod and wherein said connecting rod has a third seat having a spherically shaped concave surface on a side thereof opposite said second seat, and said machine includes another fluid coupling similar to said one fluid coupling in seated engagement with said third seat.

14. The machine according to claim 13 including an expansion member having a chamber, a wall of said chamber being resilient, and two spaced apart openings in said expansion member in communication with said chamber, wherein said third hole of said first seat is in communication with one of said two openings and the other of said two openings is in communication with said source of high pressure hydraulic fluid.

15. The machine according to claim 14 wherein said expansion member comprises a tube having an interior, said interior being said chamber, one end of said tube being open and the other end having a flange extending radially outwardly and completely closing said other end of said tube, said one end having said first seat disposed therein with a fluid tight seal between an outer surface of said seat and said one end, said spherical surface of said first seat facing outwardly.

16. The machine according to claim 15 wherein said frame includes a hole formed substantially perpendicular to said ram axis and extending from an outer surface of said frame to a point adjacent said ram bearing, said tube being disposed in said hole and being a slip fit therein, said flange attached to said outer surface of said frame.

17. The machine according to claim 16 wherein each of said ram and said ram bearing have a clearance opening therethrough, and wherein said one fluid coupling extends through said clearance openings.

18. A high speed machine for performing stamping and forming operations on strip material at a speed of up to 6000 strokes per minute, said machine having:

(a) a frame;

(b) a drive shaft journaled in said frame;

(c) a base plate attached to said frame for holding first tooling;

(d) a ram arranged to undergo reciprocating motion within a ram bearing in said frame toward and away from said base plate along a ram axis, and to carry second tooling for mating with said first tooling for performing said stamping and forming operations;

(e) a connecting rod having a first end coupled to said drive shaft by means of an eccentric coupling and a second end pivotally coupled to said ram so that upon rotation of said drive shaft said connecting rod causes said ram to undergo said reciprocating motion;

(f) a source of high pressure hydraulic fluid; and (g) an upper hydrostatic bearing and a lower hydrostatic bearing coupling respective upper and lower portions of said ram to said ram bearing and interconnected to said source of high pressure hydraulic fluid, wherein said connecting rod has a hydrostatic bearing in said first end and a bore in said second end thereof and wherein said eccentric coupling is disposed within said hydrostatic bearing with a specific amount of clearance space between said eccentric coupling and an interior surface of said hydrostatic bearing, said hydrostatic bearing including a plurality of spaced recesses formed in said interior surface thereof, each recess including a port in communication with said source of high pressure hydraulic fluid so that hydraulic fluid under high pressure fills said recesses and said clearance space thereby maintaining at least a portion of said clearance space during rotation of said drive shaft, and wherein said ram includes a pin journaled therein, said pin extending through said bore.

19. A high speed machine for performing stamping and forming operations on strip material, said machine having:

(a) a frame;

(b) a drive shaft journaled in said frame;

(c) a base plate attached to said frame for holding first tooling;

(d) a ram arranged to undergo reciprocating motion within a ram bearing in said frame toward and away from said base plate along a ram axis, and to carry second tooling for mating with said first tooling for performing said stamping and forming operations;

(e) a connecting rod having a first end coupled to an eccentric on said drive shaft by means of a hydrostatic bearing and a wrist pin attached to a second end of said connecting rod, said wrist pin being journaled in said ram so that upon rotation of said drive shaft said connecting rod causes said ram to undergo said reciprocating motion; and (f) a source of high pressure hydraulic fluid, wherein said hydrostatic bearing is interconnected to said source of high pressure hydraulic fluid by means of a fluid coupling and arranged so that said drive shaft can rotate said eccentric, with respect to said connecting rod, at a speed of up to 6000 revolutions per minute.

20. The machine according to claim 19 wherein said fluid coupling comprises:

(a) a first member having a bore in one end thereof, the other end having a spherically shaped convex surface, and a first hole formed into said spherically shaped convex surface in communication with said bore; and (b) a second member having an outer diameter on one end thereof that is a slip fit with said bore, the other end having a spherically shaped convex surface, and a second hole formed into said spherically shaped convex surface through said second member and through said one end, said one end being in slip fit engagement with said bore of said first member so that said second hole is in communication with said first hole, wherein said machine includes:

(c) a first seat having a spherically shaped concave surface associated with said frame having a third hole formed therethrough in communication with said source of high pressure hydraulic fluid, said spherically shaped convex surface of one of said first and second members being in fluid sealing seated engagement with said spherically shaped concave surface of said first seat; and (d) a second seat having a spherically shaped concave surface on said connecting rod and having a fourth hole formed thereinto in communication with said first hydrostatic bearing, said spherically shaped convex surface of the other of said first and second members being in fluid sealing seated engagement with said second seat, so that said first hydrostatic bearing is in communication with said high pressure hydraulic fluid through said fluid coupling, whereby, as said ram undergoes said reciprocating motion said high pressure hydraulic fluid within said fluid coupling urges said first and second members in opposite directions so that said spherically shaped ends are urged into said seated engagement with their respective first and second spherical seats, and said first and second members telescope together to maintain said seated engagement.

21. The machine according to claim 20 including an expansion member having a chamber, a wall of said chamber being resilient, and two spaced apart openings in said expansion member in communication with said chamber, wherein said third hole of said first seat is in communication with one of said two openings and the other of said two openings is in communication with said source of high pressure hydraulic fluid.

22. The machine according to claim 21 wherein said frame includes a hole formed substantially perpendicular to said ram axis and extending from an outer surface of said frame to a point adjacent said ram bearing, said tube being disposed in said hole and being a slip fit therein, said flange attached to said outer surface of said frame.

23. The machine according to claim 22 wherein each of said ram and said ram bearing have a clearance opening therethrough, and wherein said one fluid coupling extends through said clearance openings.

* * * * *